United States Patent [19]

Koyama

[11] Patent Number: 5,056,768

[45] **Date of Patent: * Oct. 15, 1991**

[54] IMAGE-FORMING MACHINE

[75] Inventor: Shigeo Koyama, Ibaraki, Japan

[73] Assignee: Mita Industrial Company Limited, Osaka, Japan

[ * ] Notice: The portion of the term of this patent subsequent to Nov. 6, 2007 has been disclaimed.

[21] Appl. No.: 497,258

[22] Filed: Mar. 22, 1990

Related U.S. Application Data

[62] Division of Ser. No. 269,716, Nov. 10, 1988, Pat. No. 4,968,016.

[30] Foreign Application Priority Data

| | | | |
|---|---|---|---|
| Nov. 10, 1987 | [JP] | Japan | 62-282201 |
| Nov. 11, 1987 | [JP] | Japan | 62-283078 |
| Nov. 30, 1987 | [JP] | Japan | 62-300074 |
| Nov. 30, 1987 | [JP] | Japan | 62-300079 |

[51] Int. Cl.[5] ..... B65H 83/00

[52] U.S. Cl. ..... 271/3; 271/4; 271/9; 271/10; 271/225; 271/287; 271/291; 271/301

[58] Field of Search ..... 271/3, 4, 9, 10, 279, 271/287, 288, 289, 291, 298, 301, 303, 65, 184–186, 225; 270/58; 355/313, 316, 319, 323

[56] References Cited

U.S. PATENT DOCUMENTS

| | | | |
|---|---|---|---|
| 4,436,406 | 3/1984 | Murasaki et al. | 271/9 X |
| 4,761,663 | 8/1988 | Piatt et al. | 271/9 X |
| 4,968,016 | 11/1990 | Koyama | 271/9 |

FOREIGN PATENT DOCUMENTS

| | | | |
|---|---|---|---|
| 57-20758 | 2/1982 | Japan . | |
| 57-156934 | 9/1982 | Japan . | |
| 156960 | 9/1982 | Japan | 271/287 |
| 60-19657 | 1/1985 | Japan . | |
| 86337 | 5/1986 | Japan | 271/3 |
| 61-124467 | 6/1986 | Japan . | |
| 62-121179 | 6/1987 | Japan . | |
| 64-8134 | 1/1989 | Japan . | |
| 197272 | 8/1989 | Japan | 271/287 |

*Primary Examiner*—David H. Bollinger

*Attorney, Agent, or Firm*—Wenderoth, Lind & Ponack

[57] ABSTRACT

A sheet feeding system for an image-forming machine includes a main body having a conveying passage therethrough for guiding sheet materials and a hand insertion feed table pivotally attached to the main body for movement between a feed position in which it can be used to feed sheet materials into the conveying passage and a storage position. The sheet feeding system also includes a separate feed unit which, when the table is in its storage position, can be aligned with the main body so that sheet materials can be fed therefrom into the conveying passage. The conveying passage guides sheet materials to either a receiving section, a sorter or back into the introduction opening of the conveying passage so as to form overlapping images. An auxiliary receiving member is pivotally mounted in the receiving section for movement between a first position in which it acts to guide sheet materials from the conveying passage into the receiving section and a second potion in which it acts to guide sheet materials either to the sorter or back into the introduction opening of the conveying passage. An upper cover member is also pivoted to the main body and acts as both a cover and a guide member.

19 Claims, 17 Drawing Sheets

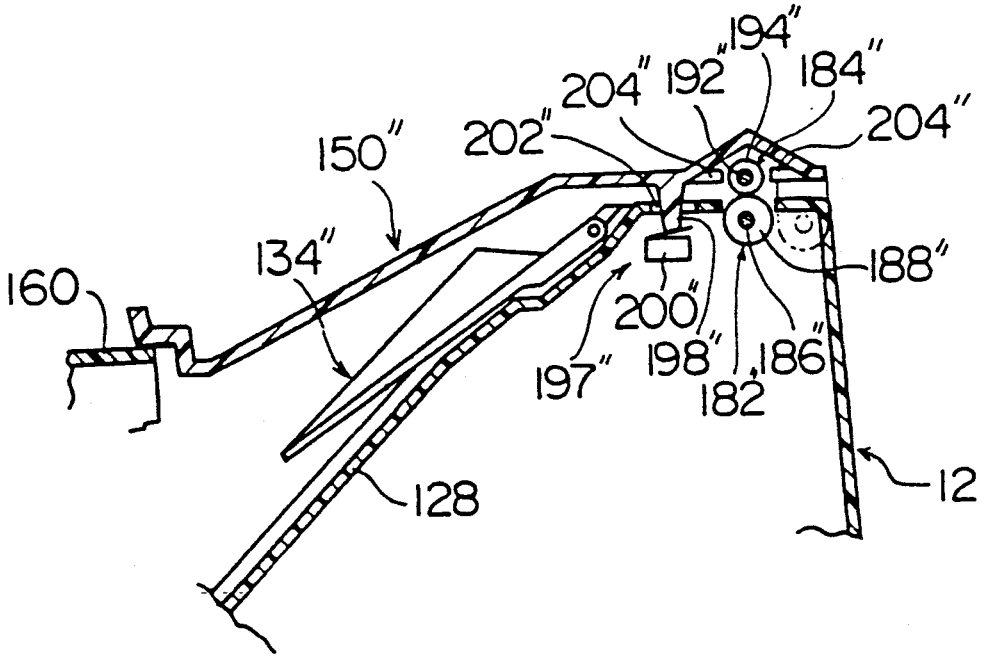
Fig. 6-A
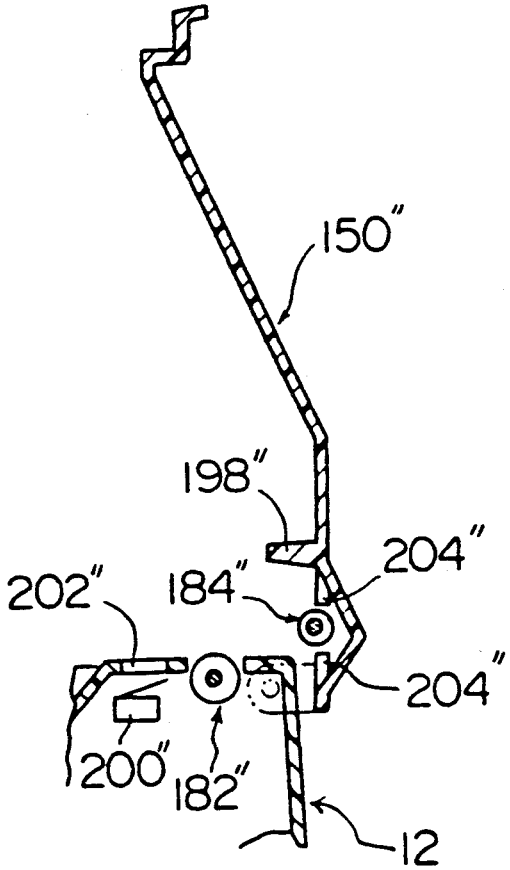
Fig. 6-B

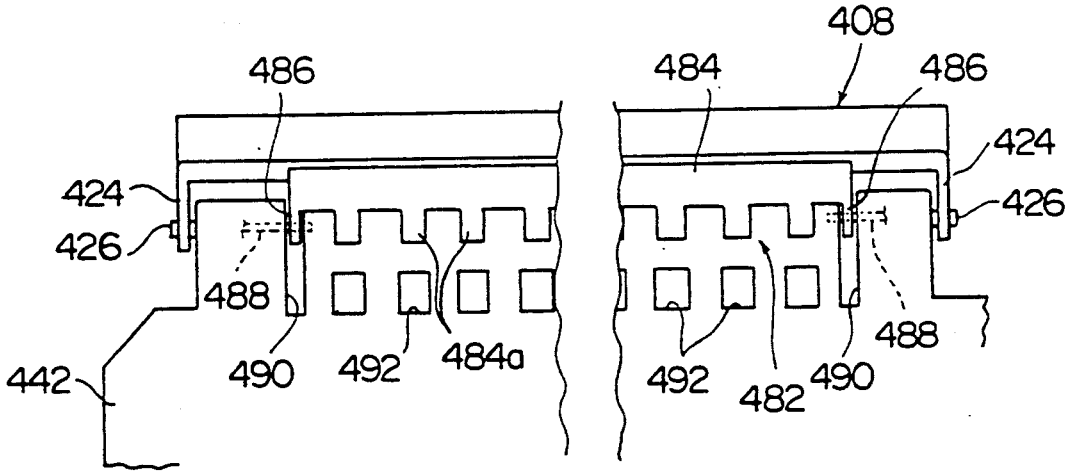
Fig. 12
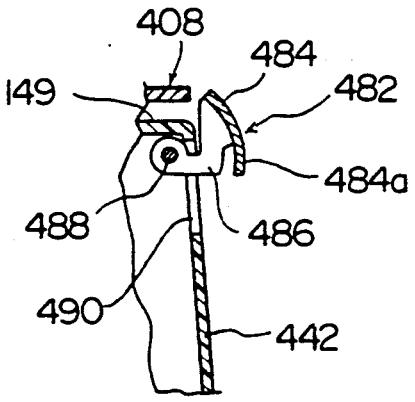
Fig. 13-A
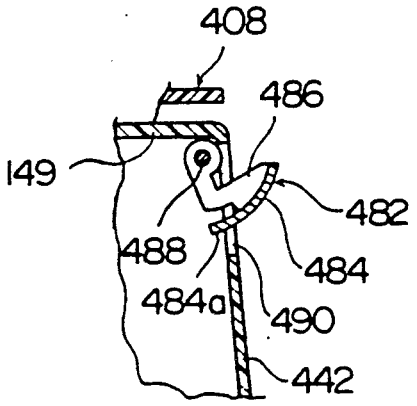
Fig. 13-B

IMAGE-FORMING MACHINE

This application is a divisional application of Ser. No. 07/269,716 filed Nov. 10, 1988 now U.S. Pat. No. 4,968,016.

FIELD OF THE INVENTION

This invention relates to an image-forming machine such as a laser beam printer.

DESCRIPTION OF THE PRIOR ART

An image-forming machine such as a laser beam printer generally includes an image-bearing means such as a rotating drum having a photosensitive material on its surface, an image-forming means for forming a toner image on the surface of the photosensitive material, a transfer means disposed in a transfer zone, a conveying passage for conveying a sheet material such as a recording sheet through the transfer zone, and a receiving section for receiving the sheet material conveyed through the conveying passage in a stacked state.

Conventional image-forming machines, however, have not proved to be entirely satisfactory, and it remains desirable to further improve them in various respects.

Firstly, in an image-forming machine of the type provided with a main body for forming an image on the surface of a sheet material and a sorter for sorting sheet materials discharged from the main body, the structure for selectively conducting the sheet materials discharged from the main body to the sorter with their image-bearing sides facing downwardly (so that no page arrangement is required later) is complex.

Secondly, when the machine is out of use, a receiving surface of the receiving section for receiving the sheet materials gathers dust. This phenomenon is not, however, limited to the above type of image-forming machine.

Thirdly, in the image-forming machine having the above-mentioned sorter, a feed means is disposed on one side of the main body, and a sorter means is disposed on the other side of the main body. A sheet material fed from the feed means is adapted to be introduced into the sorter means through a conveying passage extending substantially linearly. Accordingly, a relatively large space is required to install the entire machine.

Fourthly, it is often desired to form overlapping images on one surface of the sheet material. In conventional image-forming machines, the structure of means for re-feeding the sheet material conveyed through the conveying passage back into the conveying passage is complex.

Fifthly, in an image-forming machine of the type in which a feed unit for automatically feeding sheet materials can selectively replace a table for conducting the sheet materials to the conveying passage, the feed unit must be detachably mounted after the table is detached from the main body. The operations of mounting and detaching the feed unit are relatively complex.

SUMMARY OF THE INVENTION

It is a first object of this invention to provide an improved sheet feeding system for an image-forming machine in which sheet materials discharged from the main body of the machine can be conducted selectively to a sorter by means having a relatively simple structure.

A second object of this invention is to provide an improved sheet feeding system for an image-forming machine in which dust adhesion to a receiving section for receiving sheet materials can be prevented.

A third object of this invention is to provide an improved sheet feeding system for an image-forming machine which can be completely installed in a relatively small space and for which a shell-type structure can be employed.

A fourth object of this invention is to provide an improved sheet feeding system for an image-forming machine which can form overlapping images by a means having a relatively simple structure.

A fifth object of this invention is to provide an improved sheet feeding system for an image-forming machine in which a feed unit can be mounted by a relatively simple operation.

Other objects and features of this invention will become apparent from the following description.

BRIEF DESCRIPTION OF THE DRAWINGS

FIGS. 6-A and 6-B are partial sectional views showing the second modified example of FIG. 5 with its upper cover member at a closed position and an open position, respectively.

FIG. 12 is a partial enlarged view showing a passage switching means and its location in the sheet feeding system of FIG. 11.

FIGS. 13-A and 13-B are partial sectional views showing the passage switching means with a switching guide plate at a first position and a second position, respectively.

DETAILED DESCRIPTION OF PREFERRED EMBODIMENTS

The invention will be described below in detail with reference to the accompanying drawings.

FIRST EMBODIMENT

Figure 1:
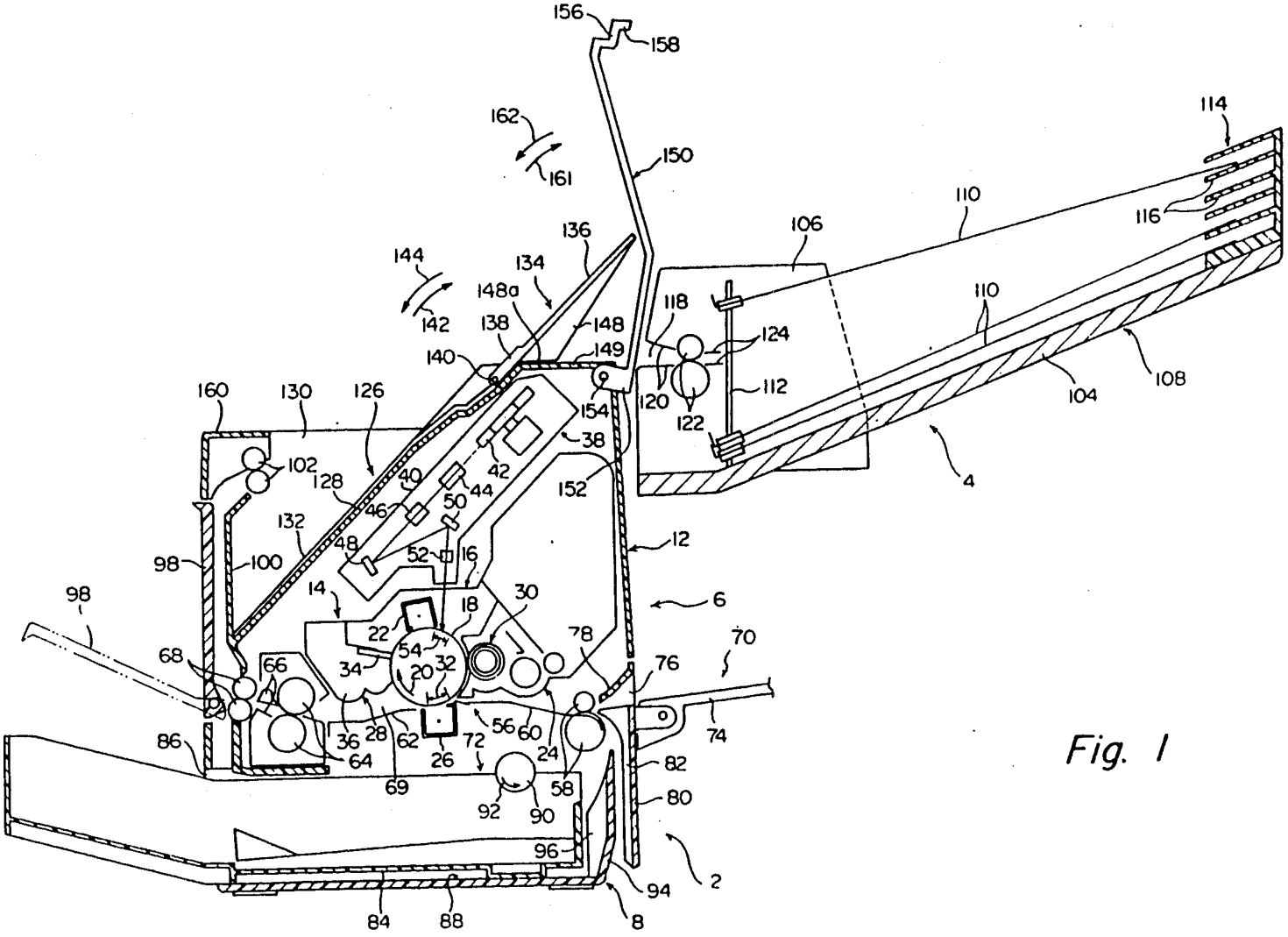
FIG. 1 is a simplified sectional view showing one example of a first embodiment of a sheet feeding system for a laser beam printer type image-forming machine, according to the invention, with an upper cover member at an open position and an auxiliary receiving member at a first position.
Figure 2:
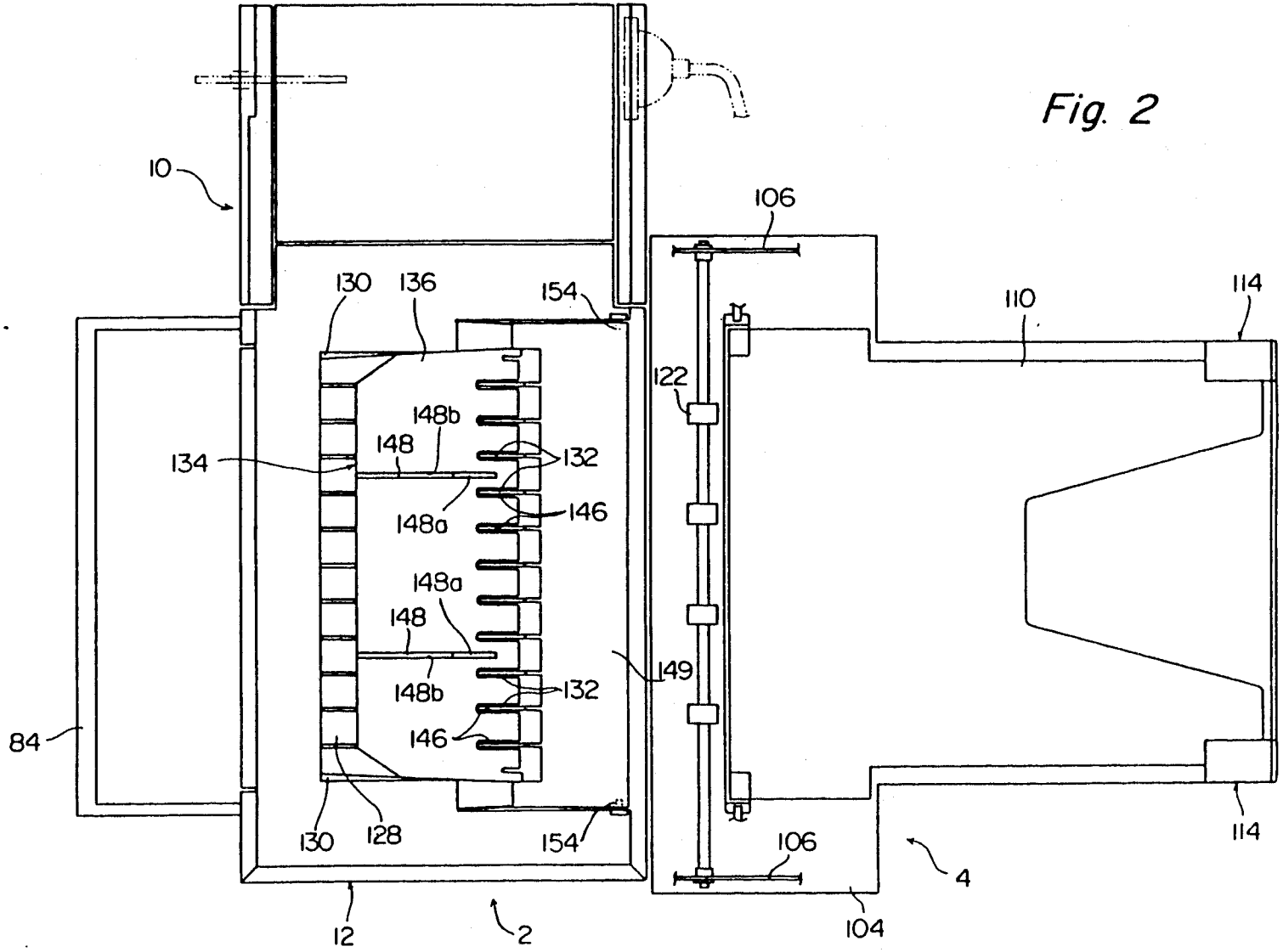
FIG. 2 is a top plan view showing the sheet feeding system of FIG. 1 with the upper cover member omitted.
Figure 3:
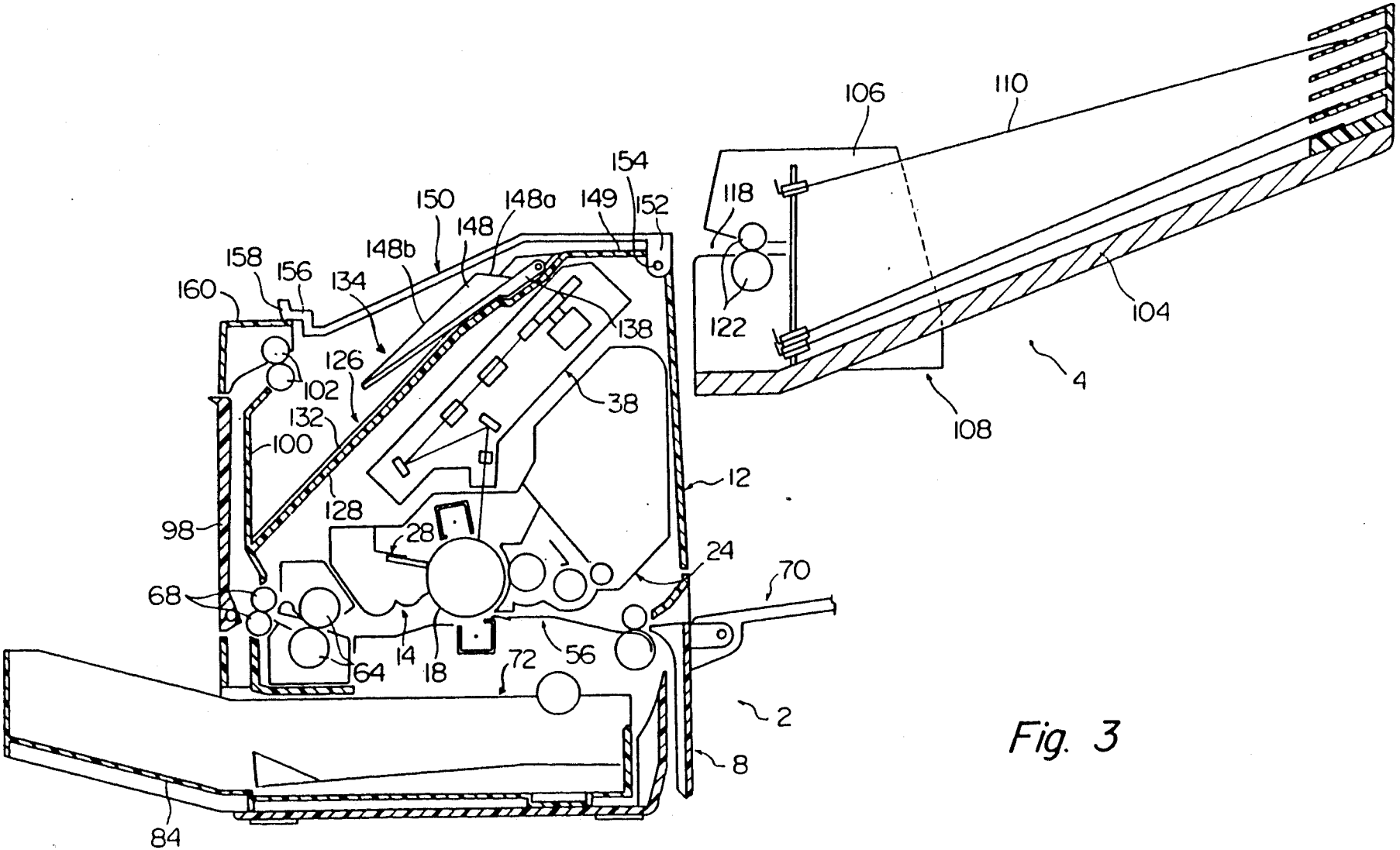
FIG. 3 is a simplified sectional view showing the sheet feeding system of FIG. 1 with its cover member at a closed position and its auxiliary receiving member at a second position.

With reference to FIGS. 1 to 3, one example of a first embodiment of a sheet feeding system for a laser beam printer type image-forming machine according to the invention will be described.

In FIGS. 1 and 2, the illustrated sheet feeding system includes a main body shown generally at 2 and a sorter shown generally at 4. The sorter 4 is adapted to be positioned at the position shown in FIGS. 1 and 3 by a supporting mechanism (not shown).

The main body 2 is provided with a rectangular parallel-piped housing 6 comprised of a lower housing 8, an upper housing 10 and an opening-closing housing 12. The opening-closing housing 12 is mounted on the upper housing 10 so as to be free to pivot between an open position (not shown) and a closed position (shown in FIGS. 1 to 3).

A process unit 14 is disposed nearly centrally in the housing 6. The illustrated process unit 14 is provided with a unit frame 16 which can be detachably mounted in the housing 6. A rotating drum 18 constituting an image-bearing means is rotatably mounted on the unit frame 16. An electrophotographic-sensitive material is disposed on the peripheral surface of the rotating drum 18. The rotating drum 18 is to be rotated in the direction shown by an arrow 20 and around the drum 18 are disposed a charging corona discharger 22, a developing device 24, a transfer corona discharger 26 constituting a transfer means and a cleaning device 28. The charging corona discharger 22, the developing device 24 and the cleaning device 28 are mounted on the unit frame 16. The charging corona discharger 22 charges the photosensitive material on the rotating drum 18 to a specific polarity. The developing device 24 is provided with a magnetic brush mechanism 30 and develops a latent electrostatic image formed as described below into a toner image. The transfer corona discharger 26 disposed in a transfer zone 32 applies a corona discharge to the back surface of a sheet material conveyed through a conveying passage as described below. The cleaning device 28 is provided with an elastic blade 34 which acts on the surface of the photosensitive material, removes the toner remaining on the surface of the photosensitive material and recovers it in a toner recovery chamber 36.

An optical unit 38 is disposed above the process unit 14 within the housing 6. The optical unit 38 has a box-like unit housing 40, and within the housing 40 are disposed a laser beam source (not shown), a rotating polygon mirror 42 to be moved in a predetermined direction, a first image-forming lens 44, a second image-forming lens 46, a first reflecting mirror 48, a second reflecting mirror 50 and a cylindrical lens 52. The laser beam source (not shown) irradiates a laser beam, based on image information outputted, for example, from a computer, toward the rotating polygon mirror 42. As shown by solid lines in FIG. 1, the laser beam reflected from the polygon mirror 42 passes through the first image-forming lens 44 and the second image-forming lens 46 and reaches the first reflecting mirror 48. It is reflected by the first reflecting mirror 48 and the second reflecting mirror 50, passes through the cylindrical lens 52 and is projected onto the surface of the rotating drum 18. A conveying mechanism shown generally at 56 is provided below the process unit 14 within the housing 6. The conveying mechanism 56 is provided with a conveyor roller pair 58, a guide plate 60, a guide plate 62, a fixing roller pair 64, a guide claw 66 and a conveyor roller pair 68 which define a main portion of a conveying passage 69 for conveying sheet materials such as recording paper. In the illustrated embodiment, the upstream end of the conveying passage 69 is bifurcated. One part extends to the right in a straight line, and a hand-insertion feed means 70 is disposed at its upstream end. The other part is curved and extends downwardly, and an automatic feed means 72 is disposed at its upstream end (more specifically, below the conveying mechanism 56 and at the bottom part of the housing 6). The hand-insertion feed means 70 is provided with a table 74 which is free to pivot between a feed position shown in FIG. 1 and a storage position (not shown) in which the table is displaced upwardly from its feed position. When the hand-insertion feed means 70 is to be used, the table 74 is positioned at the feed position. When a sheet material is positioned on the table 74 and inserted through an opening 76 formed in the right wall surface of the housing 6, the sheet material is conducted to the conveying roller pair 58 past the space between the undersurface of a guide plate 78 and the upper end edge of a guide protrusion 82 provided on the inside surface of a wall 80 of the lower housing 8. The illustrated automatic feed means 72 is provided with a cassette 84 in which sheet materials are loaded in a stacked state. The cassette 84 is detachably loaded into a cassette receiving section 88 defined in the bottom part of the housing 6 through an opening 86 formed in the left wall surface of the lower housing 8. A feed roller 90 is disposed above the cassette receiving section 88. Accordingly, when the feed roller 90 is rotated in the direction shown by an arrow 92, the sheet materials are delivered one by one from the cassette 84. The delivered sheet materials are guided by a guide protrusion 96 provided in an upstanding wall 94 in the lower housing 6 and the guide protrusion 82 provided on the wall 80, and conducted to the conveyor roller pair 58.

The downstream end portion of the conveying passage 69 is bifurcated. In this regard, an opening-closing cover 98 constituting part of the opening-closing housing 12 is mounted so as to be free to pivot between a first position shown by a solid line in FIG. 1 and a second position shown by a two-dot chain line in FIG. 1. When the opening-closing cover 98 is at the first position, the sheet material fed by the conveyor roller pair 68 is further conveyed upwardly and conducted to a discharge roller pair 102 through the space between the opening-closing cover 98 and a wall 100 of the opening-closing housing 12, and is discharged out of the housing 6 by the action of the discharge roller pair 102. On the other hand, when the opening-closing cover 98 is at the second position, the sheet material fed by the conveyor roller pair 68 is directly discharged out of the housing 6 without being conveyed upwardly and received on the inside surface (the upper surface in the state shown by the two-dot chain line) of the cover 98.

The illustrated sorter 4 is provided with a supporting frame 108 comprised of a bottom wall 104 and a pair of side walls 106 (FIG. 2) extending upwardly from the bottom wall 104. A plurality of vertically spaced bin trays 110 are disposed between the pair of side walls 106. One end portion (the left end portion in FIGS. 1 and 2) of each of the bin trays 110 is vertically movably supported along a supporting post 112, and the other end portion (the right end portion in FIGS. 1 and 2) of each of the bin trays 110 is supported by one of a plurality of supporting protrusions 116 of a supporting member 114. An elevating-lowering mechanism (not shown) is further disposed on one side of the bin trays 110 to successively move the left-most end portions of the bin trays 110 upwardly or downwardly in succession. The left surface, in FIGS. 1 and 2, of the sorter 4 has defined therein an introduction opening 118. A sheet material introduced, in a manner to described below, through the introduction opening 118 passes through an introduction passage defined by a guide plate pair 120, an introduction roller pair 122 and a guide plate pair 124 and is received in one of the bin trays 110.

With reference to FIG. 1, the operation of the sheet feeding system described above is briefly stated below.

While the rotating drum 18 is rotated in the direction of arrow 20, the charging corona discharger 22 charges the photosensitive material of the rotating drum 18, and then in the projection zone 54, a laser beam having a certain piece of image information from the laser beam source (not shown) of the optical unit 38 is projected onto the photosensitive material to form a latent electrostatic image corresponding to the image information on the surface of the photosensitive material. Thereafter, the magnetic brush mechanism 30 of the developing device 24 applies a toner to the latent electrostatic image on the photosensitive material to develop it into a toner image. Thus, by the action of the image-forming machine comprised of the charging corona discharger 22, the optical unit 38 and the developing device 24, a toner image is formed on the rotating drum 18. Then, a sheet material fed from the hand-insertion feed means 70 or the automatic feed means 72 is brought into contact with the photosensitive material in the transfer zone 32 to transfer the toner image from the photosensitive material to the sheet material. The sheet material bearing the toner image is peeled from the rotating drum 18 and conveyed to the fixing roller pair 64. By the action of the fixing roller pair 64, the toner image is fixed to the surface of the sheet material. The sheet material bearing the fixed toner image is conveyed by the conveyor roller pair 68, and, when the opening-closing cover 98 is at the second position, directly discharged onto the cover 98. As can be seen from FIG. 1, the discharged sheet material has the image-bearing surface turned upwardly. In contrast, when the cover 98 is at the first position, the sheet material conveyed by the conveying roller pair 68 is further conveyed upwardly between the cover 98 and the wall 100, and by the action of the discharge roller pair 102, discharged toward the receiving section 126 provided in the opening-closing housing 12. In this case, the discharged sheet material has the image-bearing surface turned downwardly. The sheet material discharged from the discharge roller pair 102 is received by the receiving section 126 of the housing 12 or, as will be described later, is introduced into the introduction passage through the introduction opening 118 of the sorter 4. Meanwhile, the rotating drum 18 continues to rotate, and by the action of the cleaning device 28, the toner remaining on the photosensitive material is removed.

With reference to FIG. 3 as well as FIGS. 1 and 2, the receiving section 126 provided in the opening-closing housing 12 and elements relating to it will be described.

In the illustrated embodiment, the receiving section 126 is defined by the upwardly extending wall 100, an inclined upper wall 128 extending upwardly and to the right in FIGS. 1 to 3 and generally triangular walls 130 disposed on both sides of the inclined upper wall 128. A receiving surface is defined by the upper surface of the inclined upper wall 128 and extends in a straight line upwardly at an angle of about 45 degrees from one end portion (the left end portion in FIGS. 1 to 3) of the main body 2 to its other end portion (the right end portion in FIGS. 1 to 3). A plurality of vertically spaced protrusions 132 extending in the direction perpendicular to the sheet surface in FIG. 2 are provided integrally on the upper surface of he inclined upper wall 128.

An auxiliary receiving member 134 is disposed on the upper end portion of the receiving section 126, namely on the upper end portion of the inclined upper wall 128. The illustrated auxiliary receiving member 134 is constructed of a plate-like member 136, and supporting projections 138 (only one of which is shown in FIGS. 1 and 3) provided at both ends of the plate-like member 136 are mounted on the upper end portion of the inclined upper wall 128 via pins 140 in such a manner as to be free to rotate in the directions shown by arrows 142 and 144 (FIG. 1). In the illustrated embodiment, as shown in FIG. 2, a plurality of elongated cuts 146 are formed in the base portion of the plate-like member 136 and correspond to the protrusions 132 on the inclined upper wall 128. A pair of triangular supporting and guiding protrusions 148, spaced from each other in the direction perpendicular to the sheet surface in FIGS. 1 and 3 are provided in the upper surface of the plate-like member 136 when the auxiliary receiving member is disposed in the position shown in FIG. 3. The auxiliary receiving member 134 of the above structure is free to pivot between a first position shown in FIG. 1 and a second position shown in FIGS. 2 and 3. When the auxiliary receiving member 134 is pivoted to the first position, the supporting surfaces **148*a* of the pair of supporting and guiding protrusions 148 abut with an upper wall 149 of the housing 12 to accurately limit the pivoting movement of the auxiliary receiving member 134 in the direction shown by the arrow 142. When the auxiliary receiving member 134 is pivoted to the second position, the bottom portions of cuts 146 formed in the plate-like member 136 abut with the protrusions 132 of the inclined upper wall 128 to accurately limit the pivoting movement of the auxiliary receiving member 134 in the direction shown by the arrow 144. At the first position, the auxiliary receiving member 134 is positioned downstream of the receiving section 126 in the sheet material discharging direction and one of its surfaces (the left surface in FIG. 11) forms an extension of the upper surface of the inclined upper wall 128 extending upwardly and to the right in a straight line in FIG. 1. At the second position, the auxiliary receiving member 134 is positioned above the upper end of the receiving section 126 such that its other surface, as well as the guide surfaces 148***b* of the supporting and guiding protrusions 148 face upwardly above the inclined upper wall 128.

An upper cover member 150 (omitted in FIG. 2) for covering the receiving section 126 is attached to the opening-closing housing 12. The upper cover member 150 is plate-like, and is bent slightly at a central portion thereof along the left to right direction of FIG. 3. Protruding portions 152 are provided at both ends of the base portion of the upper cover member 150, and a stop portion 156 is provided at a free end portion of the upper cover member 150. The protruding portions 152 are rotatably mounted to the opening-closing housing 12 via pins 154. A gripping protrusion 158 is further provided at the end of the stop portion 156. With this arrangement, the upper cover member 150 can be easily pivoted in the directions shown by arrows 161 and 162 (FIG. 1) by holding the gripping protrusion 158. When the upper cover member 150 is pivoted in the direction of arrow 161 and held at an open position as shown in FIG. 1, an overhead space of the receiving section 126 is open to view. In the open position, the upper surface of the upper cover member 150 abuts with part of the sorter 4, and consequently, the upper cover member 150 is prevented from pivoting in the direction of arrow 161 beyond the open position. When the upper cover member 150 is pivoted in the direction of arrow 162 and positioned at a closed position as shown in FIG. 3, the overhead space of the receiving section 126 is covered and the receiving section 126 is not exposed to view. In the closed position, the stop portion 156 of the upper cover member 150 abuts with a wall 160 of the opening-closing housing 12. As a result, the upper cover member 150 is prevented from pivoting in the direction of arrow 162 beyond the closed position.

In the sheet feeding system described above, at the time of conducting the sheet material discharged from the discharge roller pair 102 to the sorter 4, the auxiliary receiving member 134 is positioned at the second position and the upper cover member 150 is positioned at the closed position. In this state, the guide surfaces 148*b* of the supporting and guiding protrusions 148 of the auxiliary receiving member 134 are inclined upwardly toward the upper wall 149 in the housing 12. The upper cover member 150 extends nearly horizontally from the wall 160 to the other end of the main body 2 above the auxiliary receiving member 134. Accordingly, the sheet material discharged from the discharge roller pair 102 is conducted to the introduction opening 118 of the sorter 4 between the auxiliary receiving member 134 and the upper cover member 150 from one end of the main body 2 of the machine toward the other end. In other words, the sheet material is fed into the sorter 4 through a passage whose lower side is defined by the aforesaid other surface of the auxiliary receiving member 134 (more specifically the guiding surfaces 148*b* of the supporting and guiding protrusions 148) and the upper surface of the upper wall 149, and whose upper side is defined by the bottom surface of the upper cover member 150. Accordingly, in this position, the auxiliary receiving member 134 acts as a lower guiding means for conducting the sheet material to the sorter 4, and the upper cover member 150 serves as an upper guiding means for conducting the sheet material to the sorter 4. In this state, the sheet material is conveyed nearly horizontally and is conducted to the introduction roller pair 122 through the introduction opening 118 of the sorter 4. To further ensure the above conveying of the sheet material, more supporting and guiding protrusions 148 may be provided on the other surface of the auxiliary receiving member 134. Furthermore, in the state shown in FIG. 3, the auxiliary receiving member 134 is stored in place in the receiving section 126, and the upper cover member 150 covers the space overhead of the receiving portion 126. Accordingly, the main body 2 of the machine becomes compact and adhesion of dust to the receiving section 126 is effectively prevented.

On the other hand, when the sheet material discharged from the discharge roller pair 102 is to be received in the receiving section 126, the upper cover member 150 is positioned at the open position, and the auxiliary receiving member 134 is held at the first position, as shown in FIG. 1. When the upper cover member 150 is pivoted in the direction of arrow 161 and positioned at the open position, the lower portion of the upper cover member 150 covers the introduction opening 118 defined in the sorter 4 so as to prevent introduction of the sheet material through the opening 118. When the upper cover member 150 is positioned at the open position, the overhead space of the receiving section 126 is open to view to allow for manipulation of the auxiliary receiving member 134 to move it to its first position. When the auxiliary receiving member 134 is pivoted in the direction of arrow 142 and positioned at the first position, the plate-like member 136 of the auxiliary receiving member 134 is inclined upwardly from the upper end of the inclined upper wall 128 and its upper surface defines a receiving surface for receiving the sheet material in cooperation with the upper surface of the inclined upper surface 128 (see FIG. 1). Accordingly, the sheet material discharged from the discharge roller pair 102 abuts with the receiving surface of the receiving section 126, moves upwardly along the receiving surface, and is deposited onto the receiving surface. Then the sheet material discharged into the receiving section 126 in the manner described above moves downwardly along the receiving surface and its trailing end abuts with the wall 100. Sheet materials so received are aligned at their trailing ends and thus received in place in the receiving section 126 in a stacked state. In this manner, the auxiliary receiving member 134 functions as an auxiliary receiving section downstream of the inclined upper wall 128, and its one surface, in cooperation with the upper surface of the inclined upper wall 128, defines a receiving surface. Thus, sheet materials of relatively large length can be received in the receiving section 126.

MODIFIED EXAMPLES OF THE FIRST EMBODIMENT

Figure 4:
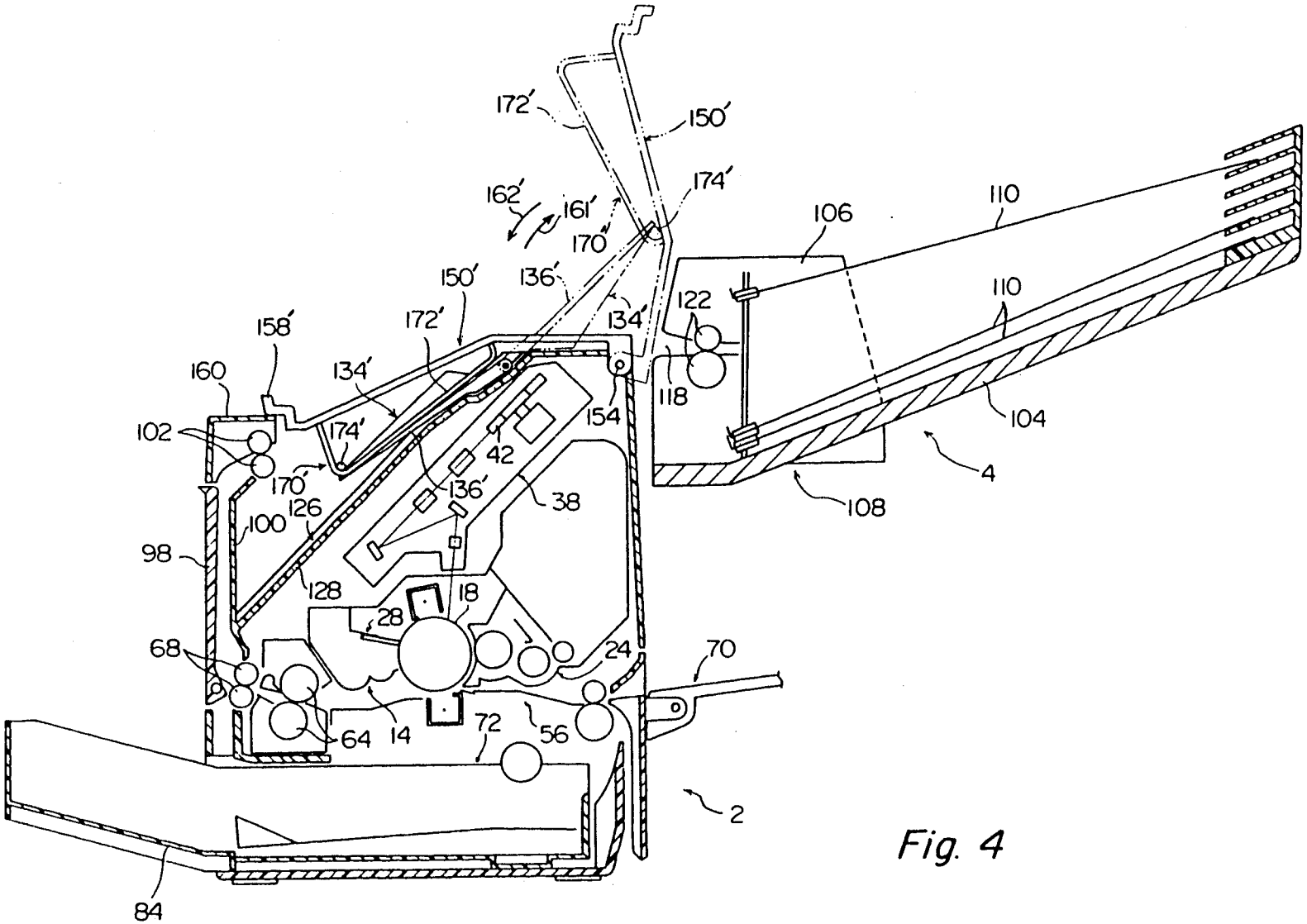
FIG. 4 is a simplified sectional view of a first modified example of the sheet feeding system of the first embodiment.

FIG. 4 shows a first modified example of the sheet feeding system of the first embodiment.

In this modified example, an interlocking mechanism is interposed between the upper cover member and the auxiliary receiving member so that pivoting of the upper cover member also causes pivoting of the auxiliary receiving member. For convenience of description, members (except for the auxiliary receiving section and the upper cover member) that are the same as those shown in FIGS. 1 to 3 are designated by the same reference numerals.

In FIG. 4, the interlocking mechanism 170' interposed between the auxiliary receiving section 134' and the upper cover member 150' includes an arm member 172' provided on the inner surface of the upper cover member 150' and an interlocking pin 174' is provided on the auxiliary receiving member 134'. The arm member 172' has its one end connected to the free end portion of the upper cover member 150' and its other end connected to a base portion (i.e. the portion near the pivoted end) of the upper cover member 150'. An opening is defined between the upper cover member 150' and the arm member 172'. The interlocking pin 174' is provided at the free end portion of the plate-like member 136', and is disposed, along with an end portion of the plate-like member 136', in the opening defined by the upper cover member 150' and the arm member 172'. The interlocking mechanism 170' may be disposed at either or both sides of the upper cover member 150'. Otherwise, the structure of the first modified example is substantially the same as that of the first embodiment shown in FIGS. 1 to 3.

When the gripping protrusion 158, of the upper cover member 150' in the first modified example is positioned and the cover member 150' is pivoted from the closed position shown by a solid line in FIG. 4 to the open position shown by a two-dot chain line in FIG. 4 in the direction of arrow 161', the auxiliary receiving member 134' is pivoted from the second position shown by a solid line in FIG. 4 to the first position shown by a two-dot chain line in FIG. 4 by the action of the interlocking mechanism 170'. Specifically, when the upper cover member 150' is pivoted in the direction of arrow 161', its pivoting movement causes the arm member 172' to lift the interlocking pin 174', and the interlocking pin 174', is moved relative to the arm member from one end portion to the other end portion of the arm member 172'. When the upper cover member 150' is moved to the open position, the interlocking pin 174' is positioned at an end portion of the opening as shown by the two-dot chain line in FIG. 4, and the auxiliary receiving member 134' is held at the first position. Accordingly, the sheet material discharged from the discharge roller pair 102 may be received in the receiving section 126 by pivoting the upper cover member 150' into its open position. As a result, the auxiliary receiving member 134' can be positioned at the first position by the interlocking mechanism 170'.

Conversely, when the upper cover member 150' is pivoted from the open position to the closed position in the direction of arrow 162', the auxiliary receiving member 134' is pivoted from the first position to the second position by the action of the interlocking mechanism 170'. Specifically, when the upper cover member 150' is pivoted in the direction of arrow 162', its bottom surface acts on the interlocking pin 174' to move the interlocking pin 174' relative to the upper cover member away from the base portion of the upper cover member 150' toward its free end. When the upper cover member 150' is moved to the closed position, the interlocking pin 174' is positioned at the end of the opening nearest the free end of the upper cover member 150', and the auxiliary receiving member 134' is held at the second position, as shown by a solid line in FIG. 4. Accordingly, the sheet material discharged from the discharge roller pair 102 may be conducted to the sorter 4 by pivoting the upper cover member 150' into its closed position. As a result, the auxiliary receiving C member 134' can be held at the second position by the interlocking mechanism 170'.

Accordingly, the first modified example of the first embodiment achieves the same operation and result as the first embodiment. Moreover, the upper cover member 150' and the auxiliary receiving member 134' can be easily moved to and positioned at the required positions by a simple operation.

Figure 5:
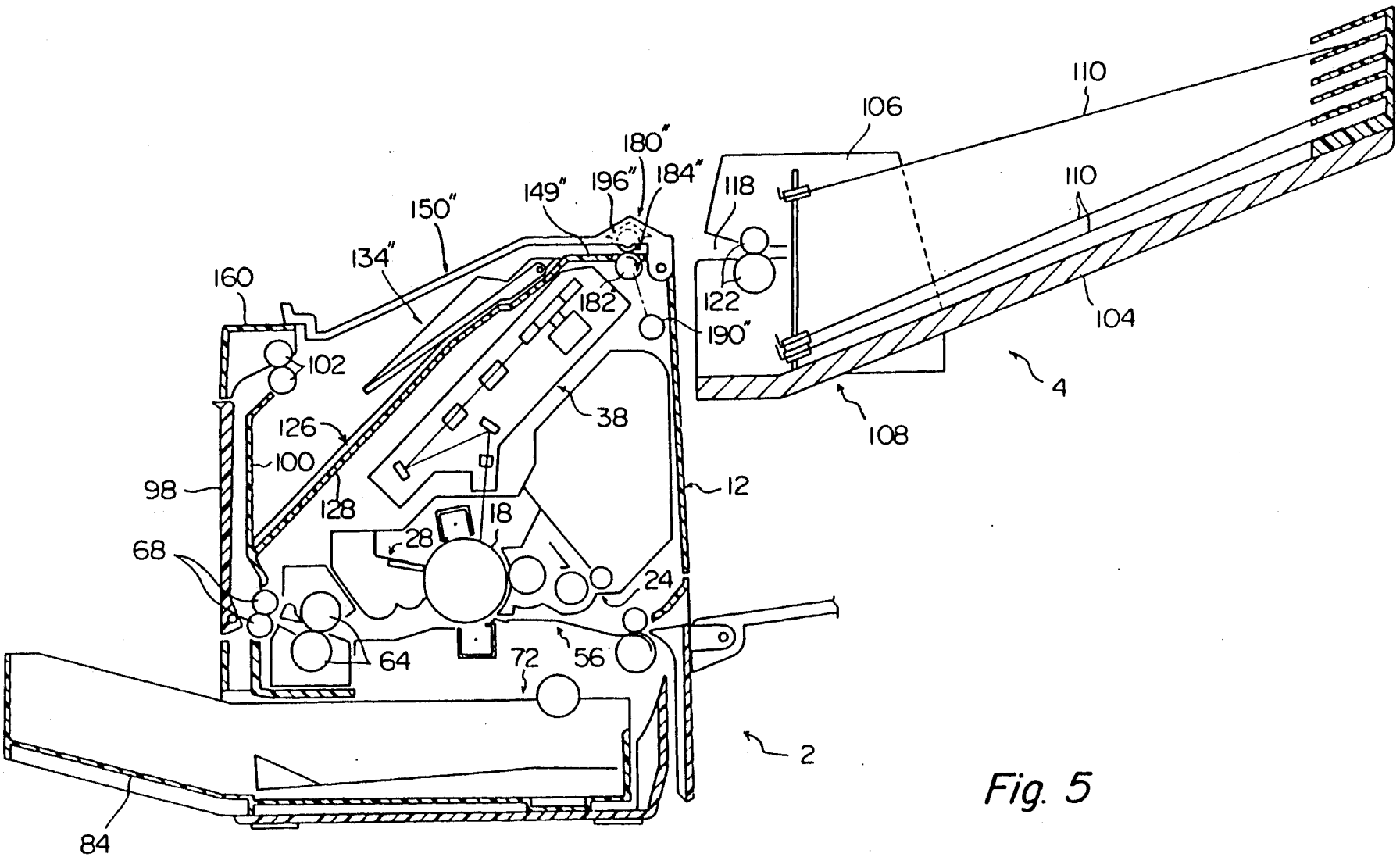
FIG. 5 is a simplified sectional view showing a second modified example of the sheet feeding system of the first embodiment.

FIGS. 5, 6-A and 6-B show a second modified example of the sheet feeding system of the first embodiment.

In the second modified example, a feed roller mechanism is disposed at the side of the opening-closing housing which is opposite the side of the housing at which the discharge roller pair is disposed, in order to permit use of relatively short sheet materials.

In the second modified example as shown in FIG. 5, the discharge roller pair 102 is disposed at the left top part in FIG. 5 of the opening-closing housing 12 at one end portion of the main body 2. When the upper cover member 150" and the auxiliary receiving member 134" are in the positions shown in FIG. 5 a sheet material discharged from the discharge roller pair 102 can be introduced into the introduction opening 118 defined in the sorter 4 past the upper surface of the upper wall 149" of the housing 12 of the main body 2. A feed roller mechanism 180" is disposed at the end of the main body 2 of the machine opposite the end having the discharge roller pair 102.

The illustrated feed roller mechanism 180" comprises a driving roller 182" disposed in the right upper end portion in FIG. 5 of the opening-closing housing 12 and a follower roller 184" disposed adjacent the pivoted end of the upper cover member 150". As shown in FIGS. 6-A and 6-B, the driving roller 182" is provided with a rotating shaft 186" and rollers 188" mounted on the rotating shaft 186". Although not shown, the rollers 188" are mounted in an axially spaced-apart relationship and the rotating shaft 186" is rotatably mounted between a pair of supporting walls. A clutch means 190" (FIG. 5) such as an electromagnetic clutch is also provided on the rotating shaft 186". the rotating shaft 186" is drivingly connected to a main driving source such as an electric motor (not shown; i.e. for actuating the rotating drum 18, the conveying mechanism 56, etc.) via the clutch mechanism 190". Hence, when the main driving source (not shown) is energized to set the clutch means 190" in operation, the driving roller 182" is rotated in the direction shown by the arrow shown in FIG. 5. As shown, the rollers 188" on the driving roller 182" project slightly upwardly through a opening formed in the upper wall 149" of the opening-closing housing 12. As shown in FIGS. 6-A and 6-B, the follower roller 184" is provided with a follower shaft 192" and rollers 194" mounted on the follower shaft 192" in an axially spaced-apart relationship (not shown), and both end portions of the follower shaft 192" are rotatably supported by supporting protrusions 196" (only one of which is shown in FIG. 5) provided at both sides of the upper cover member 150". As the follower roller 184" is so mounted, a portion of the upper cover member 150" near the pivoted end thereof projects slightly upwardly in a triangular shape, and the follower roller 184" is disposed in the space formed as a result of this upwardly projected part of the base portion of the upper cover member 150". With this structure, when the upper cover member 150″ is at the closed position shown in FIG. 6-A (as well as FIG. 5), the follower roller 184″ is positioned above the driving roller 182″ and cooperates with it. The feed roller mechanism 180″ is therefore in a feed state. On the other hand, when the upper cover member 150″ is moved to the open position shown in FIG. 6-B, the follower roller 184″ moves away from the driving roller 182″, and the follower roller 184″ becomes spaced from the driving roller 182″. The feed roller mechanism 180″ is thus moved into a non-feed state.

In the second modified example, a closed position detecting means 197″ is provided for detecting when the upper cover member 150″ is in the closed position (see FIGS. 6-A and 6-B). The detecting means 197″ includes an actuating piece 198″ provided on the upper cover member 150″ and a switch means 200″ disposed within the housing 12. When the upper cover member 150″ is at the open position, the actuating piece 198″ is positioned above the switch means 200″ and does not act on a detecting arm of the switch means 200″, as shown in FIG. 6-B. Thus, the switch means 200″ is open (off). On the other hand, when the upper cover member 150″ is pivoted and positioned at the closed position, the actuating piece 198″ presses the detecting arm of the switch means 200″ through an opening 202″ formed in the upper wall 149″ to keep the switch means 200″ closed (on).

With regard to the closed position detecting means 197″, the second modified example is further constructed as follows. When the detecting means 197″ is detecting the closed position of the upper cover member 150″ (i.e. the switch means 200″ is closed), the clutch means 190″ (FIG. 5) is adapted to be energized on the basis of a detection signal outputted from the switch means 200″. Accordingly, when a start switch (not shown) for starting the image-forming process is depressed, the main driving source (not shown) and the clutch means 190″ are energized to rotate the driving roller 182″ in the direction of the arrow via the clutch means 190″ and cause the follower roller 184″ to follow the rotation of the driving roller 182″. Accordingly, when the sheet material is discharged from the discharge roller pair 102 to the feed roller mechanism 180″ and is passed between the auxiliary receiving member 134″ at its second position and the upper cover member 150″ at its closed position, it is further conveyed by the action of the driving roller 182″ and the follower roller 184″ and conducted to the introduction opening 118 of the sorter 4. To ensure accurate feeding of the sheet material, it is preferable to provide a guiding protrusion 204″ extending toward the rollers 194″ of the follower roller 184″, as shown in FIGS. 6-A and 6-B. In contrast, when the closed position detecting means 197″ is not detecting the closed position of the upper cover member 150 (i.e. the switch means 200″ is in the open state), the clutch means 190″ is kept from being energized on the basis of a signal outputted from the switch means 200″. Accordingly, even when the start switch (not shown) is depressed in this state, the main driving source (not shown) is energized but the clutch means 190″ is not energized. As a result, the driving roller 182″ and the follower roller 184″ are not rotated, and sufficient safety is ensured.

Otherwise, the structure of the second modified example is substantially the same as that of the embodiment shown in FIGS. 1 to 3. The second modified example achieves the same results as the first embodiment. In addition, even relatively short sheet materials can be fed to the sorter 4 by the action of the feed roller mechanism 180″.

SECOND EMBODIMENT

Figure 7:
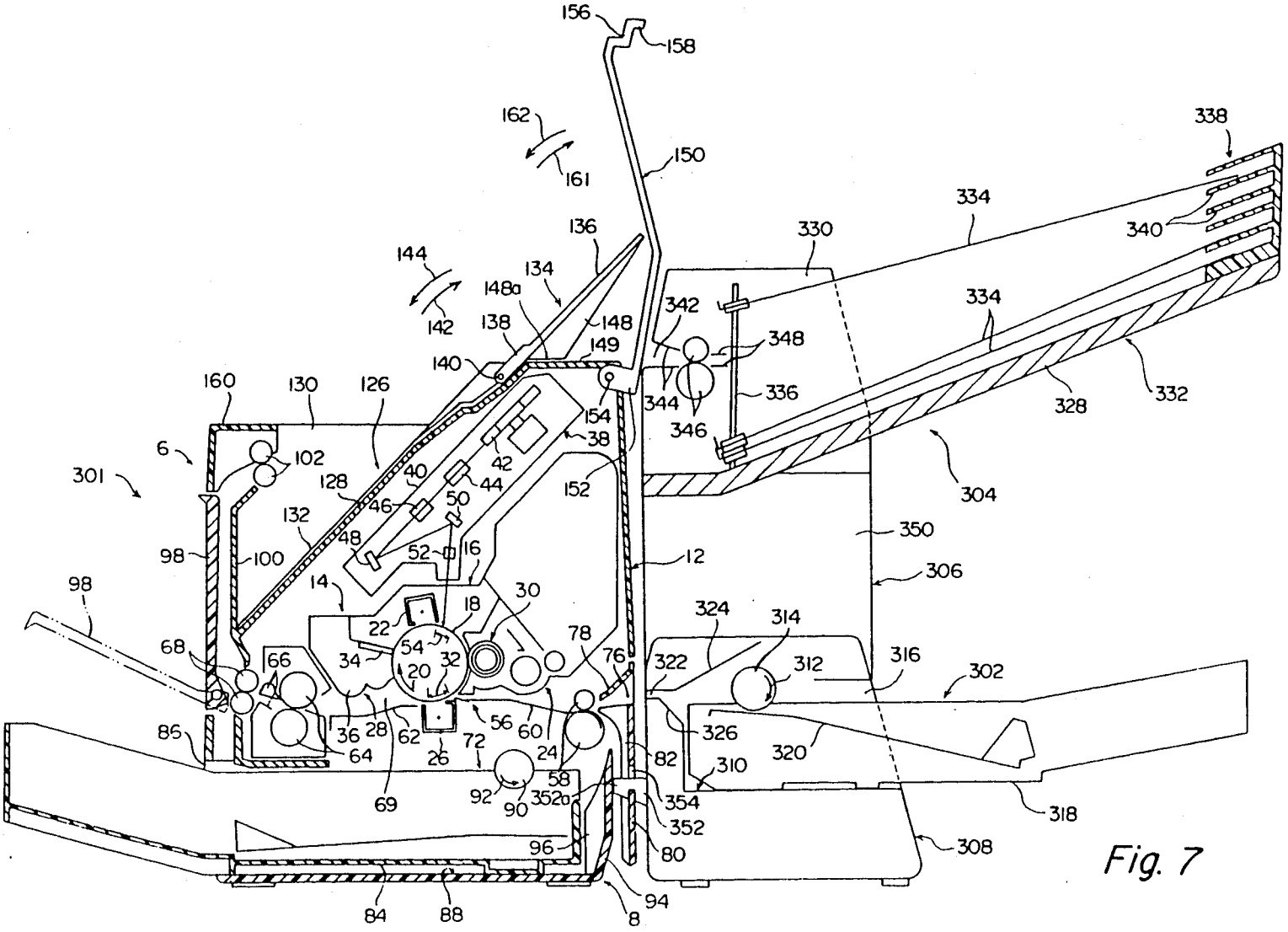
FIG. 7 is a simplified sectional view showing one example of a second embodiment of the sheet feeding system of the invention with an upper cover member at an open position and an auxiliary receiving member at a first position.
Figure 8:
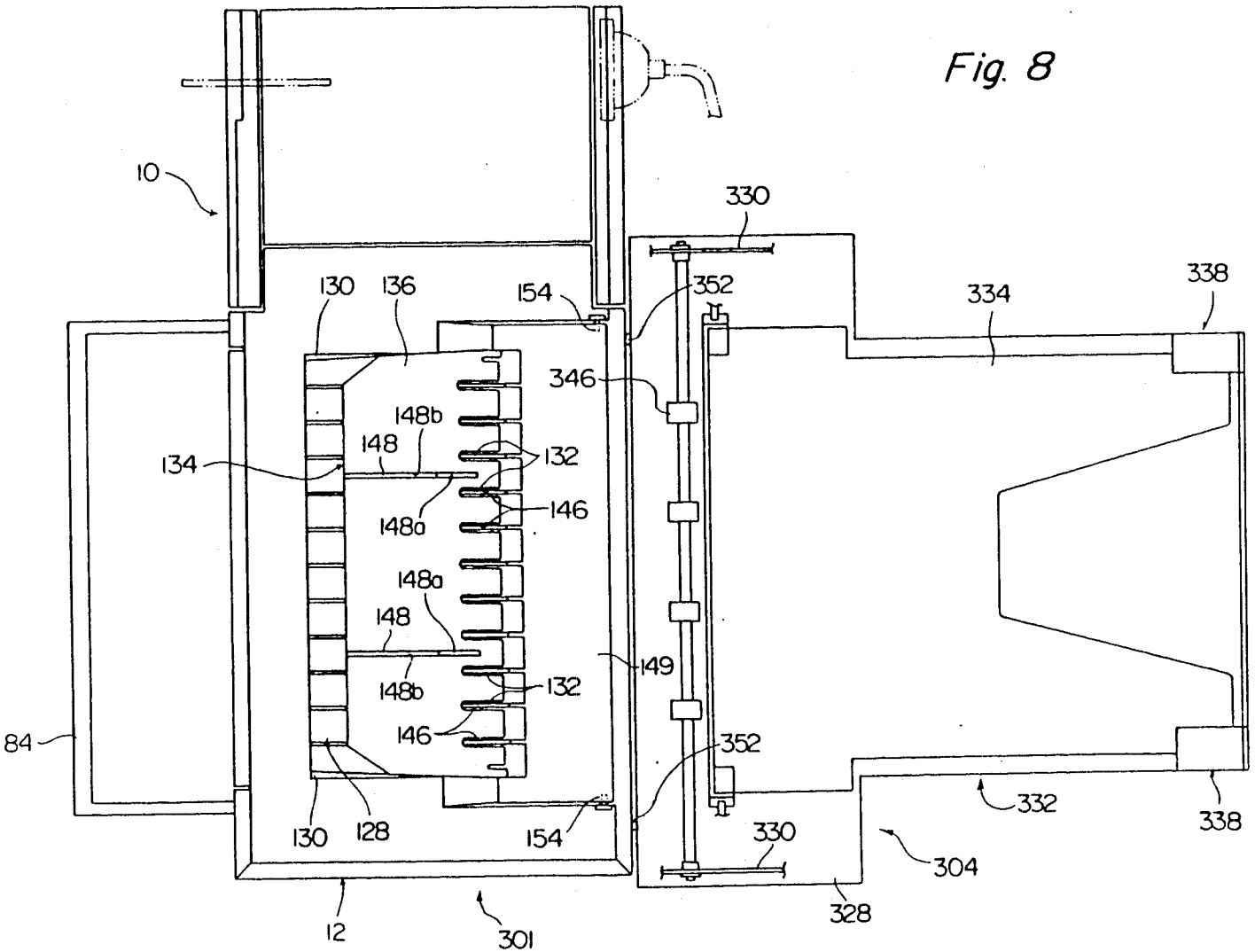
FIG. 8 is a top plan view showing the sheet feeding system of FIG. 7 with its cover member omitted.
Figure 9:
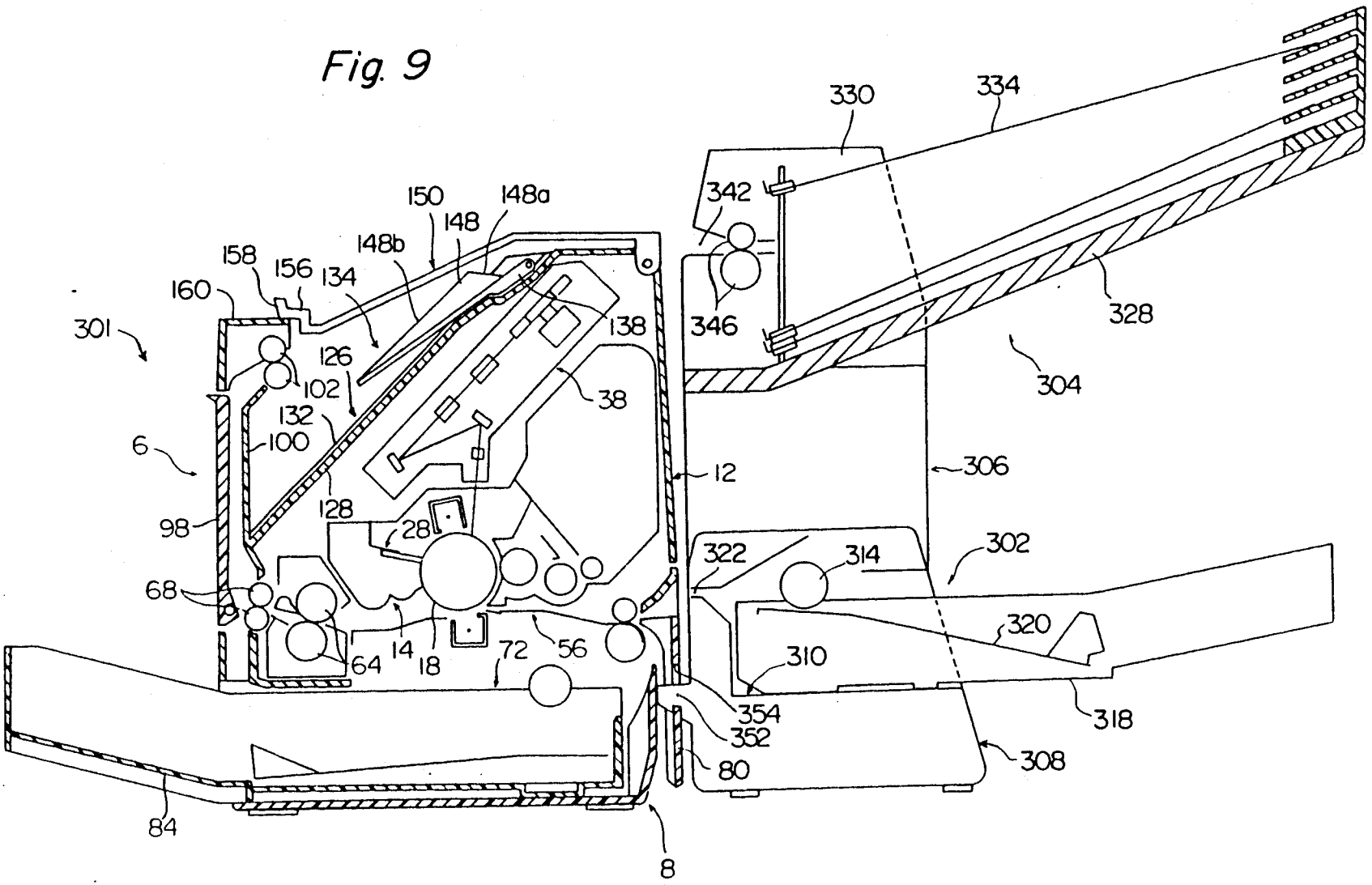
FIG. 9 is a simplified sectional view showing the sheet feeding system of FIG. 7 with the upper cover member at a closed position and its auxiliary receiving member at a second position.

FIGS. 7 to 9 show one example of a second embodiment of the sheet feeding system of the invention.

In FIGS. 7 and 8, the illustrated sheet feeding system includes a main body shown generally at 301, a feed means shown at 302 and a sorter shown at 304. The feed means 302 and the sorter 304 are mounted on a supporting unit 306. A comparison of FIG. 1 with FIG. 7 will readily show that the main body 2 in the first embodiment is substantially the same in structure as the main body 301 in the second embodiment, and parts in the second embodiment which are the same as parts in the first embodiment are designated by like reference numerals and will not be described again.

The illustrated feed means 302 is constructed as a unit and detachably mounted on the bottom portion of the supporting unit 306. The feed means 302 is provided with a feed housing 308 in which a cassette-receiving section 310 is defined. A feed roller 314 adapted to rotate in the direction shown by an arrow 312 is disposed above the cassette-receiving section 310. A loading opening 316 is defined in the right-hand surface in FIG. 1 of the feed housing 308. A box-like cassette 318 is detachably loaded into the cassette-receiving section 310 through the loading opening 316. A plate 320, adapted to be biased upwardly by the action of a biasing means (not shown), such as a spring, about a fulcrum point at the rear end (or right-hand end in FIG. 7) of the plate 320, is provided in the cassette 318, and sheet materials are placed on the plate 320 in the stacked state. In the left surface in FIG. 7 of the supporting unit 306, a delivery opening 322 is defined, and guide plates 324 and 326 defining a delivery passage are disposed between the delivery opening 322 and the cassette-receiving section 310.

The sorter 304 is also constructed as a unit, and is mounted detachably on the upper portion of the supporting unit 306. The sorter 304 is provided with a bottom wall 328 and a pair of side walls 330 (FIG. 8) extending upwardly from the bottom wall 328. A plurality of vertically spaced bin trays 334 are disposed between the pair of side walls 330. One end portion (the left end portion in FIGS. 7 and 8) of each of the bin trays 334 is vertically movably supported by a supporting post 336, and the other end portion (the right end portion in FIGS. 7 and 8) of each of the bin trays 334 is supported by a supporting projection 340 of a supporting member 338. An elevating mechanism (not shown) is also disposed at the left end portions of the bin trays 334. The elevating mechanism moves the left end portions of the bin trays 334 successively upwardly or downwardly. An introduction opening 342 is defined in the left surface in FIGS. 7 and 9 of the supporting unit 306, and a sheet material introduced through the introduction opening 342, in a manner to be described, is received in any of the plurality of bin trays 334 via an introduction passage defined by a guide plate pair 344, an introduction roller pair 346 and a guide plate pair 348.

The supporting unit 306 is provided with a pair of spaced base plates 350 (only one of which is shown in FIG. 7), and the feed means 302 is mounted between the bottom portions of the pair of base plates 350. The sorter 304 is mounted between the upper parts of the base plates 350. As shown in FIGS. 7 and 8, the supporting unit 306 is disposed on the right-hand side of the main body 301 of the machine, and is connected releasably to the lower housing 8 of the main body 301. An alignment means is provided to align the delivery opening 322 with the introduction opening 76. Such alignment means preferably comprises a pair of engaging pieces 352 (see FIG. 8) provided at the left end in FIGS. 7 and 8 of the supporting unit 306. An engaging opening 354 corresponding to the pair of engaging pieces 352 is formed at a predetermined site in the wall 80 of the lower housing 8. Accordingly, the supporting unit 306 is detachably secured to the housing 8 by inserting the engaging pieces 352 through the engaging opening 354 and bringing claw portions 352*a* thereof (FIG. 7) into engagement with the engaging opening 354 in the wall 80. In this secured state, the delivery opening 322 defined in the supporting unit 306 is connected to the introduction opening 76 defined in the machine housing 6, and a feed passage to the sorter 304 which is defined above the housing 6 as stated below is connected to the introduction opening 342 defined in the supporting unit 306. In the illustrated embodiment, the supporting unit 306 is secured to one side of the main body 301 of the machine, and thus the feed means 302 and the sorter 304 are disposed on that side of the main body 301. Accordingly, as can be easily understood from FIG. 7, the entire machine is relatively compact and the installation space can be relatively small. Furthermore, as in the embodiment described, it is easy to employ a shell-type supporting structure in which part of the housing 6 is opened upwardly.

In the second embodiment, when a sheet material discharged from the discharge roller pair 102 is to be received in the receiving section 126, the upper cover member 150 is positioned at the open position and the auxiliary receiving member 134 is positioned at the first position, as shown in FIG. 7. When the upper cover member 150 is pivoted in the direction of arrow 161 and positioned at the open position, the base portion of the upper cover member 150 covers the introduction opening 342 defined by the supporting unit 306 to prevent introduction of the sheet material through the introduction opening 342. When the upper cover member 150 is positioned at the open position, the overhead space of the receiving section 126 is opened to permit the auxiliary receiving member 134 to be positioned at the first position. When the auxiliary receiving member 134 is pivoted in the direction of arrow 142 and positioned at the first position, the upper cover member 150 and the auxiliary receiving member 134 are positioned as shown in FIG. 7. Specifically, the plate-like member 136 of the auxiliary receiving member 134 is inclined upwardly from the upper end of the inclined upper wall 128 and its upper surface, in cooperation with the upper surface of the inclined upper wall 128, defines a receiving surface for receiving the sheet material. Hence, the sheet material discharged from the discharge roller pair 102 contacts the receiving surface of the receiving section 126 and moves upwardly along the receiving surface. The sheet material discharged into the receiving section then moves downwardly along the receiving surface of the receiving section 126 by its own weight until its trailing end abuts with the wall 100. The sheet materials so received are aligned at their trailing ends as a result of abutting with the wall 100 and are, thus, stacked in the receiving section 126.

On the other hand, when the sheet material discharged from the discharge roller pair 102 is to be conducted to the sorter 304, the auxiliary receiving member 134 is positioned at the second position, and the upper cover member 150 is held at the closed position. In this state, the guiding surfaces 148*b* of the supporting guide projections 148 of the auxiliary receiving member 134 are inclined upwardly toward the upper wall 149 of the opening-closing housing 12. The upper cover member 150 extends nearly horizontally from the wall 160 to the upper wall 149 above the auxiliary receiving member 134. Accordingly, as shown in FIG. 9, a feed passage for conducting the sheet material to the sorter 304 is defined above the machine housing 6 (the lower side of the feed passage is defined by the guiding surfaces 148*b* of the supporting guide projections 148 and the upper surface of the wall 149 of the opening-closing housing 12 and the upper side of the feed passage is defined by the lower surface of the upper cover member 150), and the sheet material discharged from the discharge roller pair 102 passes through the feed passage from the left end portion of the housing 6 toward its right end and is conducted to the introduction opening 342 of the sorter 304. The auxiliary receiving member 134, therefore, acts as a lower guide means for conducting the sheet material to the sorter 304, and the upper cover member 150 acts as an upper guide means for conducting the sheet material to the sorter 304. To perform the above conveyance of the sheet material more accurately, additional supporting guide projections 148 may be provided on the surface of the auxiliary receiving member 134. In the state shown in FIG. 9, the auxiliary receiving member 134 is stored in the receiving section 126 and the upper cover member 150 covers the overhead space of the receiving portion 126. Accordingly, the main body 301 of the machine becomes compact and dust is prevented from gathering in the receiving section 126.

MODIFIED EXAMPLE OF THE SECOND EMBODIMENT

Figure 10:
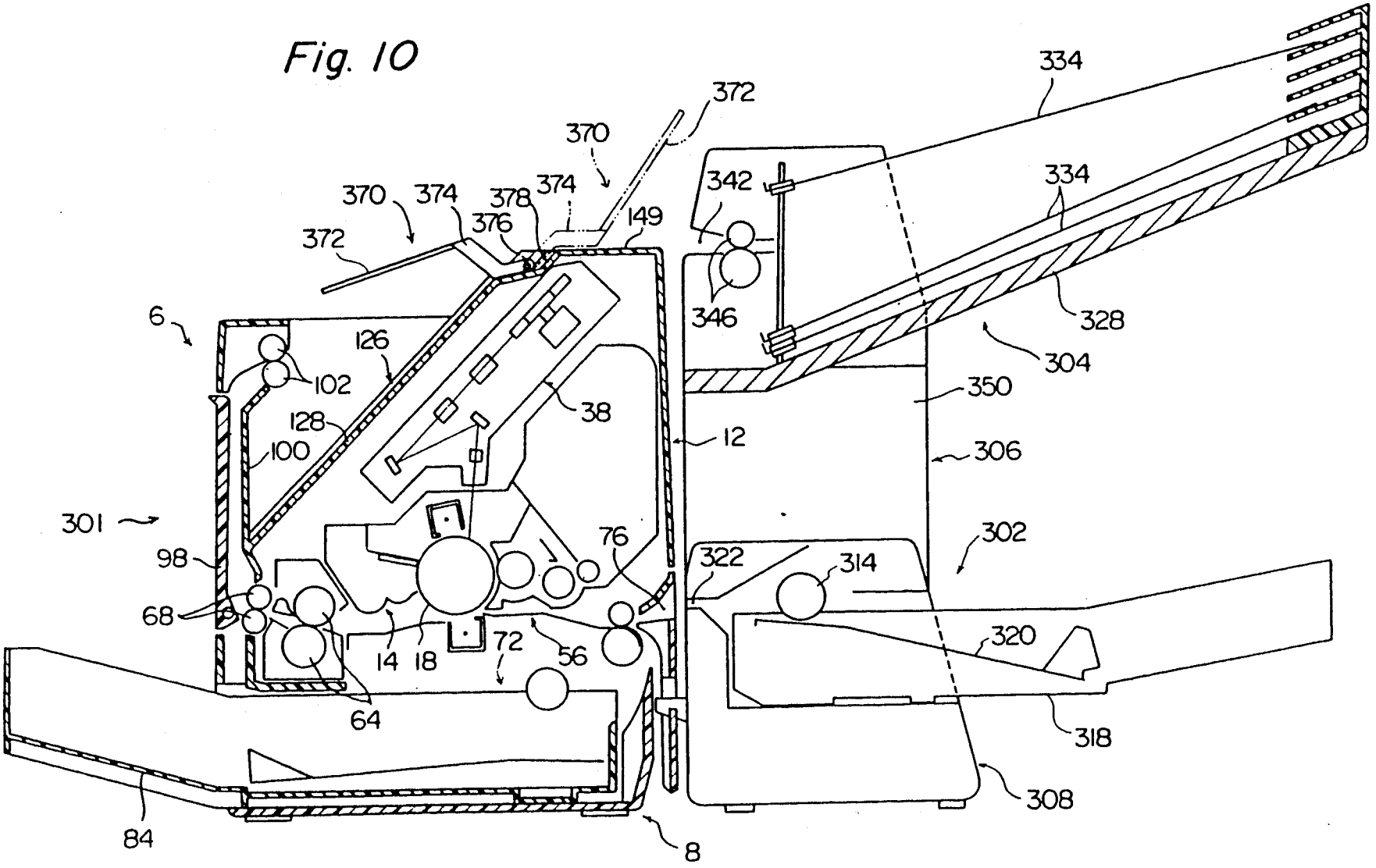
FIG. 10 is a simplified sectional view showing a modified example of the sheet feeding system of the second embodiment.

FIG. 10 shows a modified example of the sheet feeding system of the second embodiment. In this modified example, an improvement is made to the auxiliary receiving member.

In FIG. 10, the auxiliary receiving member 370 is provided with a plate-like main body portion 372 and supporting projections 374 (only one of which is shown in FIG. 10). Each of the supporting projections 374 is pivotably mounted on the upper end portion of the receiving section 126 via a pin 376 (or more specifically, at a location where a depressed portion 378 is provided in the upper end portion of the receiving section 126). The auxiliary receiving member 370 of this structure may be used in place of both the auxiliary receiving member 134 and the upper cover member 150 of the second embodiment shown in FIGS. 7 to 9. Otherwise, the structure of the modified example is substantially the same as that of the second embodiment shown in FIGS. 7 to 9.

When the sheet material is to be received in the receiving section 126, the auxiliary receiving member 370 is held at a first position shown by a two-dot chain line in FIG. 10. When it is positioned at the first position, the supporting projections 374 abut with the upper wall 149 of the opening-closing housing 12 to prevent pivoting movement of the auxiliary receiving member 370 beyond the first position. At the first position, the main body portion 372 of the auxiliary receiving member 370 is inclined upwardly from the upper end of the inclined upper wall 128, and its inner surface (the left surface in the state shown by the two-dot chain line in FIG. 10) cooperates with the upper surface of the inclined upper wall 128 to define a receiving surface for receiving the sheet material. The main body portion 372 shuts off the feed passage for feeding the sheet material to the sorter 304. Accordingly, the sheet material discharged from the discharge roller pair 102 is received in the receiving section 126 in the same manner as described above. On the other hand, when the sheet material is to be conducted to the sorter 304, the auxiliary receiving member 370 is positioned at a second position shown by a solid line in FIG. 10. When it is positioned at the second position, the supporting projection 374 abuts with the upper end portion of the inclined upper wall 128 to prevent pivoting movement of the auxiliary receiving member 370 beyond the second position. At the second position, the main body portion 372 extends substantially horizontally above the inclined upper wall 128. The inner surface of the main body portion 372 (the under surface in the state shown by the solid line in FIG. 10) defines an upper side of the feed passage for conducting the sheet material to the sorter 304, and a lower side of the feed passage is defined by the upper surface of the inclined upper wall 128 and the upper surface of the upper wall 139. Accordingly, the sheet material discharged by the action of the discharge roller pair 102 is guided at its upper surface by the inner surface of the main body portion 372 of the auxiliary receiving member 370 and conducted to the introduction opening 342 defined in the supporting unit 306 through the feed passage.

THIRD EMBODIMENT

FIGS. 11 to 14 show one example of a third embodiment of the sheet feeding system of the invention.

Figure 11:
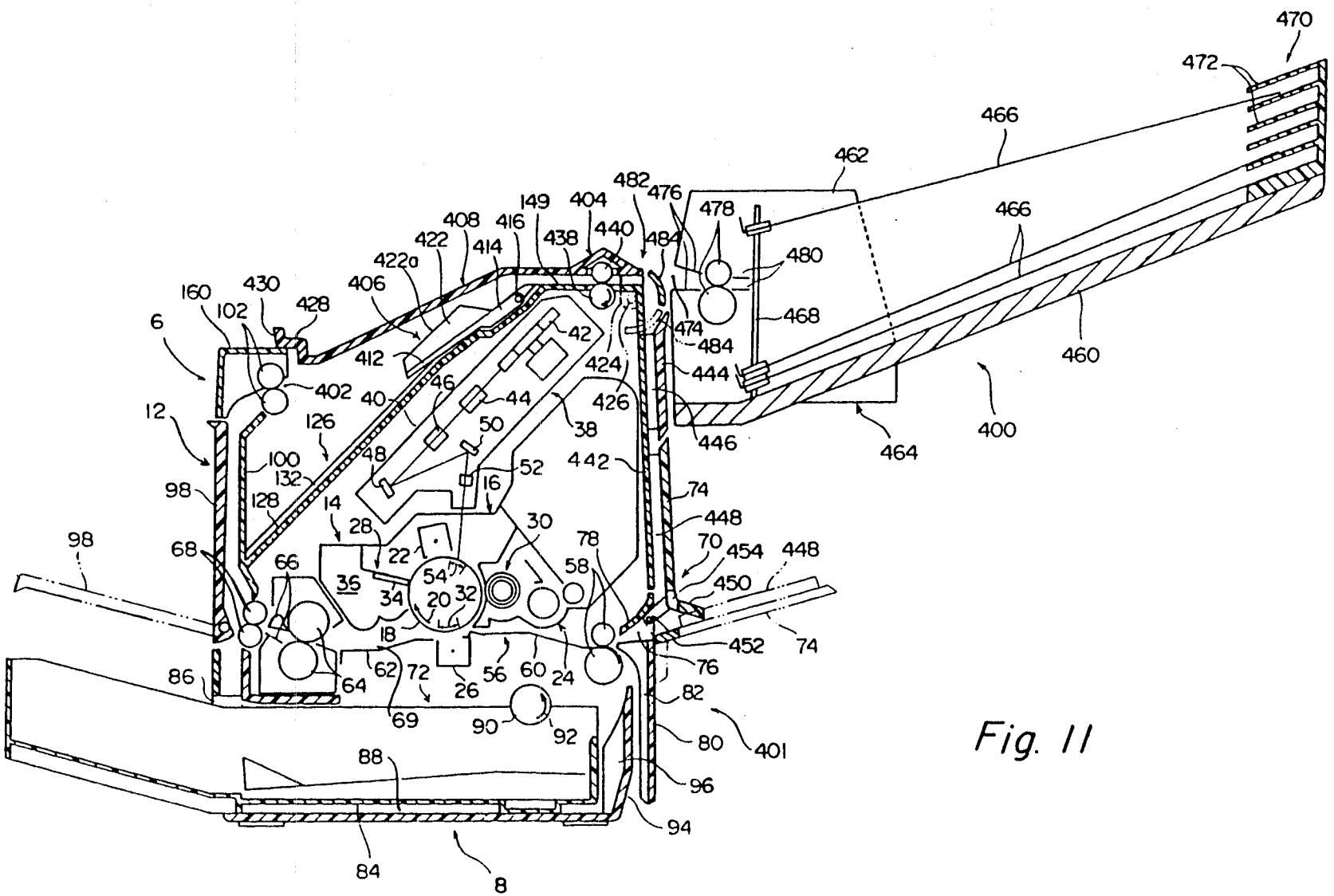
FIG. 11 is a simplified sectional view showing one example of a third embodiment of the sheet feeding system of the invention with an upper cover member at a closed position and an auxiliary receiving member at a second position.

In FIG. 11, the illustrated sheet feeding system is provided with a main body shown generally at 401 and a sorter shown generally at 400. A comparison of FIG. 1 with FIG. 11 will readily show that the main body 2 in the first embodiment and the main body 401 in the third embodiment differ only slightly with regard to the auxiliary receiving member, the upper cover member and related elements, and are basically the same in structure. Parts of the third embodiment which are the same as parts in the first embodiment will be designated by like reference numerals, and will not be described again.

Figure 14:
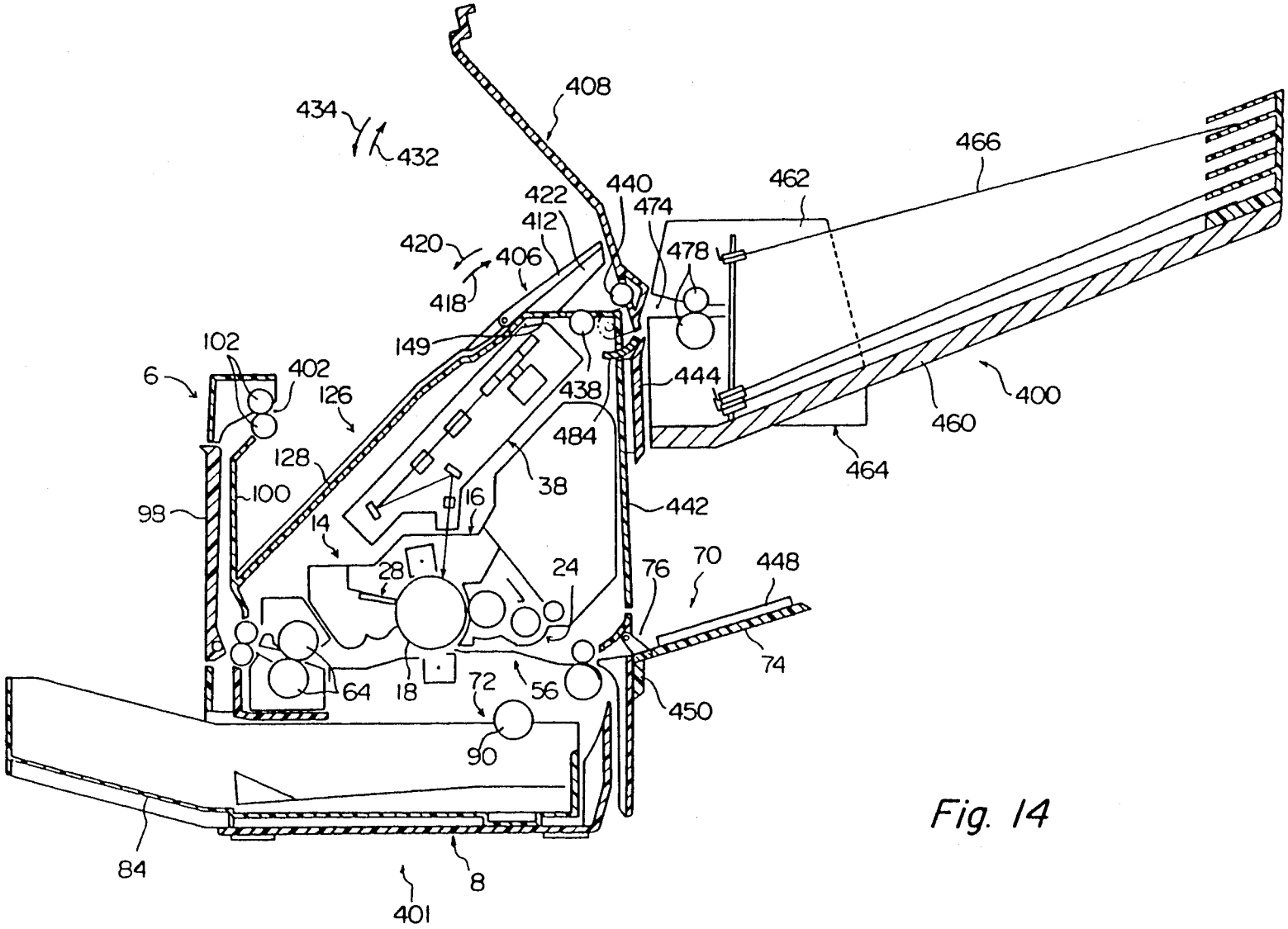
FIG. 14 is a simplified sectional view showing the sheet feeding system of FIG. 11 with its upper cover member at an open position and its auxiliary receiving member at a first position.

With reference to FIGS. 11, 13 and 14, in the third embodiment, a re-introducing conveying means is provided for selectively conducting the sheet material delivered from the discharge roller pair 102 to a conveying passage and re-conveying it therethrough. The re-introducing conveying means defines a re-introducing conveying passage for conducting the sheet material delivered from a delivery opening 402 along a path outside the machine housing 6 and the opening 76 which acts as an introduction opening. In the illustrated embodiment, the re-introducing conveying means is provided with a feed roller mechanism 404 disposed at the upper end of the other end portion (the right end portion in FIGS. 11 and 14) of the machine housing 6. It also includes an auxiliary receiving member 406 mounted on the receiving section 126 and an upper cover member 408 mounted on the machine housing 6. The receiving section 126 is defined by the perpendicular wall 100 and the inclined upper wall 128 inclined upwardly from the lower end portion of the wall 100 toward the right in FIGS. 11 and 14. Its receiving surface, defined by the inclined upper wall 128, is inclined upwardly at an angle of about 45 degrees from one end portion of the machine housing 6 toward its other end portion. The auxiliary receiving member 406 is provided in the upper end portion (the right-hand end portion in FIGS. 11 and 14) of the receiving section 126. The illustrated auxiliary receiving member 406 is provided with a plate 412 and supporting projections 414 (only one of which is shown in FIGS. 11 and 14) provided at both ends of the plate 412. The supporting projections are mounted via pins 416 on the upper end portion of the inclined upper wall 128 so as to be free to pivot in the directions shown by arrows 418 and 420 (FIG. 14). The auxiliary receiving member 406 is free to pivot between a first position shown in FIG. 14 and a second position shown in FIG. 11. When the auxiliary receiving member 406 is pivoted to the first position, a pair of supporting guide protrusions 422 provided on the plate 412 abuts with the upper wall 149 of the opening-closing housing 12 to prevent the pivoting movement of the auxiliary receiving member 406 in the direction shown by the arrow 418 beyond the first position. When it is pivoted to the second position the plate 412 abuts with part of the inclined upper wall 128 to prevent pivoting movement of the auxiliary receiving member 406 in the direction of the arrow 420 beyond the second position. At the first position, the auxiliary receiving member 406 is positioned on the downstream side of the receiving section 126 in the sheet discharging direction, and its one surface (the left surface in FIG. 14) is inclined upwardly in a straight line from the right-hand end of the inclined upper wall 128 toward the right in FIG. 14 and shuts off the re-introducing conveying passage, as shown in FIG. 14. On the other hand, at the second position, the auxiliary receiving member 406 is positioned above the upper end portion of the receiving section 126 and its other surface, particularly the guiding surfaces 422*a* of the supporting guide projections 422, are inclined upwardly in a straight line toward the right in FIG. 11 above the inclined upper wall 128, to thereby define one side (the under side) of part of the re-introducing conveying passage, as shown in FIG. 11.

The upper cover member 408 is pivotally mounted on the upper end of the other end portion (the right end portion in FIGS. 11 and 14) of the machine housing 6. The illustrated upper cover member 408 is in the form of a plate which is slightly bent at a substantially central portion thereof along the left to right direction in FIG. 11. Protrusions 424 are provided at one end of the base portion of the upper cover member 408 at both sides thereof, and are mounted pivotally via the pins 426 (see FIG. 12). A stop portion 428 is provided at the free end portion of the upper cover member 408, and a gripping protrusion 430 is provided at the end of the stop portion 428. With this arrangement, the upper cover member 408 can be easily pivoted in the directions shown by arrows 432 and 434 (FIG. 14) by holding the gripping protrusion 430. When the upper cover member 408 is pivoted in the direction of the arrow 432 and positioned at an open position as shown in FIG. 14, the overhead space of the receiving section 126 is opened to permit the auxiliary receiving member 406 to be positioned at the first position. For example, as shown in FIG. 14, when the sorter 400 is provided adjacent to the main body 2 of the machine, the upper surface of the upper cover member 408 abuts with part of the sorter 400 such that pivoting movement of the upper cover member 408 in the direction of arrow 432 beyond the open position is prevented. On the other hand, when the upper cover member 408 is pivoted in the direction of arrow 434 and held at the closed position as shown in FIG. 11, it extends substantially horizontally above the receiving section 126, and its under surface defines the other side (the upper side) of part of the re-introducing conveying passage. When the cover member 408 is pivoted to the closed position, the stop portion 428 of the upper cover member 408 abuts with the upper wall 160 of the opening-closing housing 12 to prevent pivoting movement of the upper cover member 408 in the direction of arrow 434 beyond the closed position. At the closed position, the upper cover member 408 covers the overhead space of the receiving section 126, and prevents dust from gathering in the receiving section 126.

The feed roller mechanism 404 is provided with a driving roller 438 and a follower roller 440 which cooperates with the driving roller 438 and feeds the sheet material downstream. The driving roller 438 is disposed at the upper end of the other end portion (right-hand end portion) of the machine housing 6, and projects slightly upwardly through an opening formed in the upper wall 149 of the opening-closing housing 12. The driving roller 438 is drivingly connected to a driving source of the image forming machine via a clutch mechanism or the like, and is rotated in the direction shown by an arrow (see FIG. 11). The follower roller 440 is rotatably mounted on the base portion of the upper cover member 408. As the follower roller 440 is so mounted, the base portion of the upper cover member 408 projects slightly upwardly in a triangular shape, and the follower roller 440 is disposed in the space formed by this projection of the base portion. With this structure, when the upper cover member 408 is at the closed position, the follower roller 440 is positioned on the upper side of the driving roller 438 and cooperates with it. The feed roller mechanism 404 is thus maintained in a feed state. On the other hand, when the upper cover member 408 is positioned at the open position, the follower roller 440 moves upwardly from the driving roller 438, and is spaced from the driving roller 438. As a result, the feed roller mechanism 404 is in a non-feed state. It is preferred to design the feed roller mechanism 404 in the manner of the embodiment shown in FIGS. 5, 6-A, and 6-B, such that when the upper cover member 408 is at the open position, the clutch means (not shown) for rotating the driving roller 438 is not energized.

Accordingly, the upstream portion of the re-introducing conveying passage, which extends substantially horizontally above the machine housing 6 from its one end portion (the left end portion in FIG. 11) to the other end portion (the right end portion in FIG. 11), is defined at its one side (the lower side) by the auxiliary receiving member 406, especially the supporting guide protrusions 422, as well as the upper wall 149 and the driving roller 438. The other side (upper side) of the re-introducing conveying passage is defined by the upper cover member 408 and the follower roller 440.

The illustrated re-introducing conveying passage is further provided with a guide wall 444 disposed outwardly of a wall 442 of the housing 12. Guide protrusions 446 (only one of which is shown in FIGS. 11 and 14) are fixed to the outside surface of the wall 442 near both sides of the guide wall 444. The guide wall 444 extends downwardly from the upper end of the wall 442, as shown in FIG. 11.

In the third embodiment, the table 74 of the hand-insertion feed means 70 defines part of the re-introducing conveying passage. A pair of guide protrusions 448 (one of which is shown in FIGS. 11 and 14) spaced from each other in the direction perpendicular to the sheet surface are provided on the upper surface in FIG. 14 of the table 74, and an abutting piece 450 is integral with and projects downwardly from one end portion of the table 74. Accordingly, when the table 74 is at the feed position, the abutting piece 450 abuts with the outside surface of the wall 80 of the lower housing 8 to prevent pivoting movement of the table 74 beyond the feed position. At the feed position, one of the guide protrusions 448 acts as a guide means for conducting sheet material positioned on the table 74 into the machine housing 6 through the opening 76. On the other hand, when the table 74 is pivoted upwardly and positioned at the storage position, the pair of guide protrusions 448 abuts with the outside surface of the wall 442 of the housing 12 to prevent pivoting movement of the table 74 beyond the storage position. It is preferable to provide a permanent magnet (not shown) in one of the table 74 (e.g. in the guide protrusions 448) and the wall 442 and an iron piece (not shown) attractable to the permanent magnet in the other of the table 74 and wall 442, so as to allow the iron piece to be magnetically attracted to, and held by, the permanent magnet when the table 74 is held in the storage position.

With this structure, the downstream portion of the re-introducing conveying passage extends substantially in the vertical direction of the right-hand side of the machine housing 6 in FIG. 11 and is defined at its one side (left side in FIG. 11) by the wall 442 and at its other side (right side in FIG. 11) by the guide wall 444 and the table 74. A sheet material conveyed through this downstream portion is guided along its edges by the pair of guide protrusions 446 provided on the guide wall 444 and the pair of guide protrusions 448 provided on the table 74.

An introduction tongue-like piece 452 for introducing the sheet material conveyed through the re-introducing conveying passage into the housing 6 through the opening 76 is further provided in the upper end of the wall 80 of the lower housing 8, and projects slightly to the right in FIGS. 11 and 14 from the outside surface of the wall 80. A receiving depression 454 is provided in the end of the table 74 (FIG. 11) and, as can be seen from FIG. 11, when the table 74 is at the feed position, the introduction tongue-like piece 452 is positioned in the receiving depression 454 to conduct the sheet material moving over the table 74 to the opening 76. On the other hand, when the table 74 is positioned at the storage position, the introduction tongue-like piece 452 defines part of the re-introducing conveying passage to conduct the sheet material conveyed through the re-introducing conveying passage to the opening 76.

The sorter 400 is disposed to the right of the main body in FIGS. 11 and 14. The sheet material conveyed through the re-introducing conveying passage is selectively conducted to the sorter 400 or the opening 76 defined in the vertically intermediate part (between the walls 442 and 80) of the other surface (right-hand surface) of the machine housing 6. With reference to FIGS. 11 and 12, the illustrated sorter 400 is provided with a supporting frame 464 consisting of a bottom wall 460 and a pair of side walls 462 (one of which is shown in FIG. 11) extending upwardly from the bottom wall 460. The supporting frame 464 is supported at the position shown in FIG. 11 by a supporting mechanism (not shown). A plurality of bin trays 466 spaced from each other vertically are disposed between the pair of side walls 462. One end portion (the left end portion in FIG. 11) of each of the bin trays 466 is vertically movably supported by a supporting post 468, and the other end portion of each of the bin trays 466 is supported by a supporting projection 472 of the supporting member 470. An elevating mechanism (not shown) is disposed at the movable end portions of the bin trays 466 such that the movable end portions of the bin trays 466 can be successively moved upwardly or downwardly. An introduction opening 474 is defined in the left surface in FIG. 11 of the supporting frame 464. The introduction opening 474 is positioned nearly opposite to the feed roller mechanism 404. Sheet material introduced through this introduction opening 474 in a manner described below passes through an introduction passage defined by a guide plate pair 476, an introduction roller pair 478 and a guide plate pair 480 and is received by any one of the bin trays 466.

A passage switching means 482 for switching the feeding direction of the sheet member is provided in the right top corner portion in FIG. 11 of the machine housing 6. With reference mainly to FIGS. 12, 13-A and 13-B, the passage switching means 482 is provided with an arcuate switching guide plate 484. Supporting plates 486 are provided at both sides of the switching guide plate 484 and are pivotally mounted via a short rod 488 to the housing 6. In this regard, an elongated opening 490 is formed in the upper end portion of the wall 442 of the opening-closing housing 12, and the supporting plate 486 is linked through the opening 490. The switching guide plate 484 is selectively pivotable between a first position shown in FIG. 13-A (also shown in FIG. 12 and by the solid line in FIG. 11) and a second position shown in FIG. 13-B (also shown in FIG. 14 and by the two-dot chain line in FIG. 11). The switching guide plate can be pivoted from one position to the other by, for example, controlling the operation of a magnetic solenoid. At the first position, the switching guide plate 484 projects above the wall 149 to shut off the introduction opening 474 of the sorter 400, curves the sheet material conveyed by the action of the feed roller mechanism 404 downwardly and conducts it between the wall 442 and the guide wall 444. At the second position, the switching guide plate 484 is positioned downwardly of the wall 149 and permits feeding of the sheet material conveyed by the action of the feed roller mechanism 404 to the sorter 400. To permit this positioning, an opening 492 is formed in the wall 442 for receiving guide protrusions 484*a* provided on the switching guide plate 484.

In order to form overlapping images on one surface of a sheet material in the sheet feeding system described above, the auxiliary receiving member 406 is positioned at the second position, the upper cover member 408 is positioned at the closed position, the table 74 is positioned at the storage position, and the switching guide plate 484 is positioned at the first position (for example, by energizing the electromagnetic solenoid) (see FIG. 11). Accordingly, the sheet material delivered from the delivery opening 402 by the action of the discharge roller pair 102 passes through the re-introducing conveying passage (one side of which is defined by the auxiliary receiving member 406, the upper wall 149 and the wall 442 and the other side of which is defined by the upper cover member 408, the switching guide plate 484, the guide wall 444, the table 74 and the introduction tongue-piece 452), passes through the feed roller mechanism 404, and is introduced into the machine housing 6 through the opening 76. As apparent from FIG. 11, a sheet material delivered from the delivery opening 402 is discharged with its image-bearing surface directed downwardly, and introduced into the opening 76 through the re-introducing conveying passage with the image-bearing surface directed upwardly. The introduced sheet material is again conveyed through the conveying passage and the toner image formed on the surface of the photosensitive material on the rotating drum 18 is transferred to the image-bearing surface in the transfer zone 32. As a result, a second toner image is overlapped with a first toner image on the image-bearing surface of the sheet material. The sheet material with one surface thereof bearing overlapping images is delivered out of the machine housing 6 through the delivery opening 402 when the switching guide plate 484 is switched over to the second position (for example, by de-energizing the electromagnetic solenoid) after the sheet material is introduced into the machine housing 6 through the re-introducing conveying passage. Hence, the sheet material is fed to the sorter 400 between the auxiliary receiving member 406 and the upper cover member 408, and sorted.

On the other hand, when the sheet material is to be fed to the sorter 400 directly without forming a second image over a first image, the auxiliary receiving member 406 is positioned at the second position, the upper cover member 408 is positioned at the closed position, and the switching guide plate 484 is positioned at the second position. With this arrangement, the sheet material delivered from the delivery opening 402 is not conducted downwardly by the switching guide plate 484, but is conducted directly to the sorter 400 between the auxiliary receiving member 406 and the upper cover member 408.

When the sheet material is to be received in the receiving section 126, the auxiliary receiving member 406 is positioned at the first position, and the cover member 408 is positioned at the open position, as shown in FIG. 14. With this arrangement, the sheet material delivered from the delivery opening 402 is not conducted by the feed roller mechanism 404, but is discharged in the receiving section 126 and then moves downwardly along the inclined upper wall 128, and is received in the receiving section 126.

MODIFIED EXAMPLE OF THE THIRD EMBODIMENT

Figure 15:
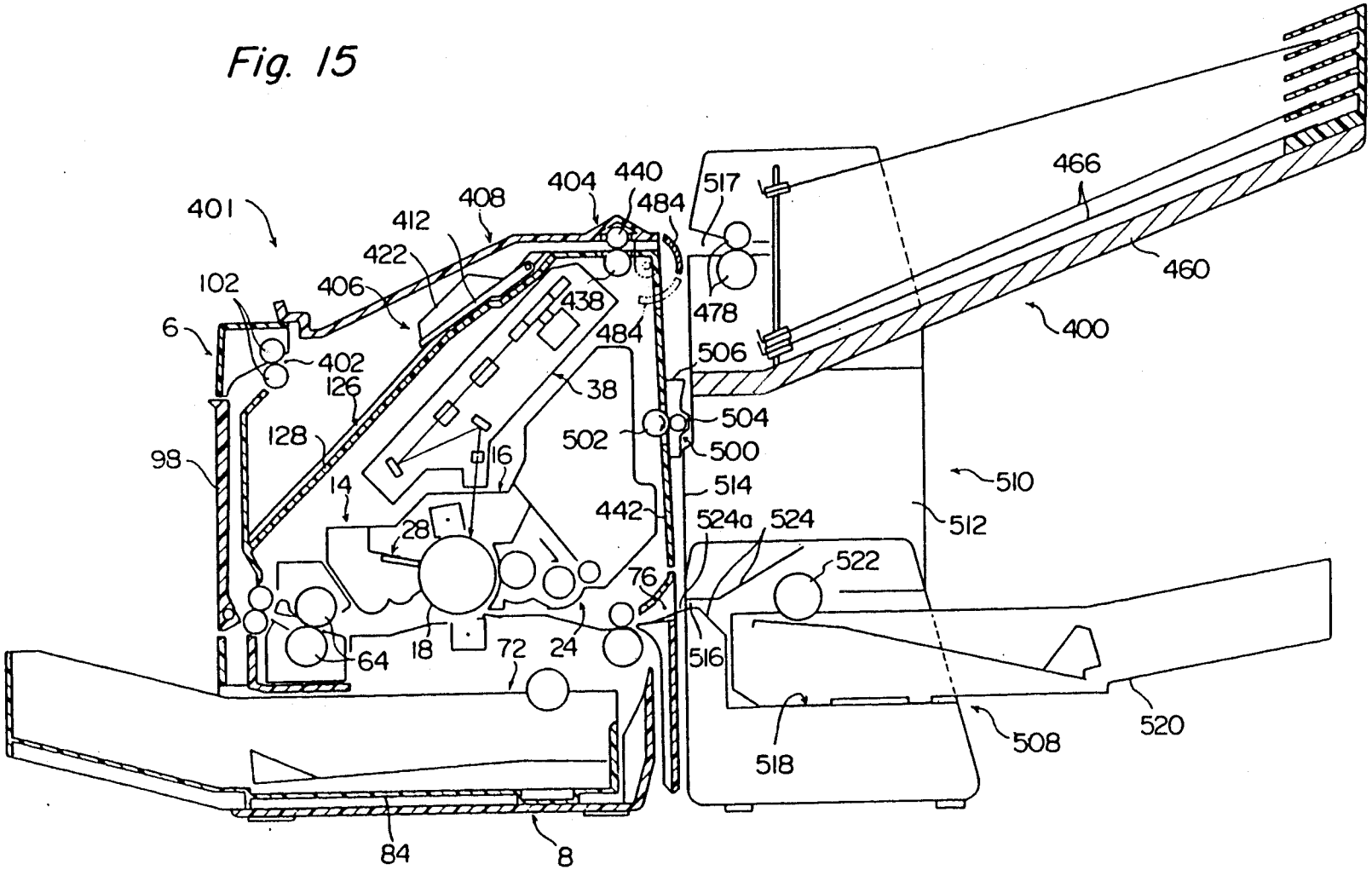
FIG. 15 is a simplified sectional view showing a modified example of the sheet feeding system of the third embodiment.

FIG. 15 shows a modified example of the sheet feeding system of the third embodiment. In this modified example, an improvement is made to the re-introducing conveying means.

In the modified example shown in FIG. 15, an auxiliary roller mechanism 500 is disposed at the right end portion in FIG. 15 of the machine housing 6. The auxiliary roller mechanism 500 is comprised of a driving roller 502 and a follower roller 504 cooperating with the driving roller 502. The driving roller 502 is mounted rotatably in the machine housing 6, drivingly connected to a driving source (not shown) of the image forming machine via a clutch means or the like, and rotated in the direction shown by an arrow (FIG. 15). The driving roller 502 projects slightly to the right in FIG. 15 through an opening formed in the wall 442 of the opening-closing housing 12. The follower roller 504 is supported rotatably on a pair of supporting projections 506 (one of which is shown) provided on the outside surface of the wall 442. The auxiliary roller mechanism 500 is disposed at a vertically intermediate part of the wall 442, engages the sheet material conveyed downwardly toward the opening 76 and feeds it further downstream.

In the modified example, an auxiliary unit 510 provided with the sorter 400 and a feed means 508 is disposed on the right-hand side in FIG. 15, and part of the auxiliary unit 510 defines part of the re-introducing conveying passage. The illustrated auxiliary unit 510 has a pair of spaced supporting base plates 512 (one of which is shown). The feed means 508 is disposed at the lower ends of the base plates 512 and the sorter 400 is disposed at the upper ends of the base plates 512. A wall 514 defining the left surface of the auxiliary unit 510 is provided at the left end of the pair of supporting base plates 512 in FIG. 15. A delivery opening 516 is defined in the lower part of the wall 514, and an introduction opening 517 is defined in the upper part of the wall 514. The wall 514 extends in the vertical direction and is substantially parallel to the wall 442 of the machine housing 6. The wall 514 defines part of the re-introducing conveying passage. The feed means 508 is provided with a cassette 520 which is adapted to be detachably loaded into a receiving section 518, and a feed roller 522 disposed above the receiving section 518. A sheet material delivered from the cassette 520 by the feed roller 522 passes between guide plates 524, through the delivery opening 516, through the opening 76 of the machine housing 6 and into the conveying passage.

In the modified example, in place of the introduction tongue-like piece of the third embodiment, the end of a lower guide plate 524*a* of the guide plate pair 524 is projected into the housing 6 through the opening 76. Accordingly, the sheet material fed from the feed means 508 is guided by the lower guide plate 524*a* and introduced precisely into the machine housing 6 through the opening 76. The sheet material conveyed through the re-introducing conveying passage is conducted to the opening 76 by the action of the end portion of the lower guide plate 524*a*, and fed to the conveying passage through the opening 76.

Otherwise, the structure of the modified example is substantially the same as that of the third embodiment.

In this modified example, the re-introducing conveying passage for conducting the sheet material delivered from the delivery opening 516 to the opening 76 is also provided on the outside of the machine housing 6. One side of the re-introducing conveying passage is defined by the auxiliary receiving member 406, the upper wall 149 and the wall 442, and the other side of the re-introducing conveying passage is defined by the upper cover member 408, the switching guide plate 484, the wall 514 of the auxiliary unit 510 and part of the guide plate 524*a*. The sheet material conveyed through the re-introducing conveying passage is fed to the opening 76 by the feed roller mechanism 404 and the auxiliary roller mechanism 500.

FOURTH EMBODIMENT

Figure 16:
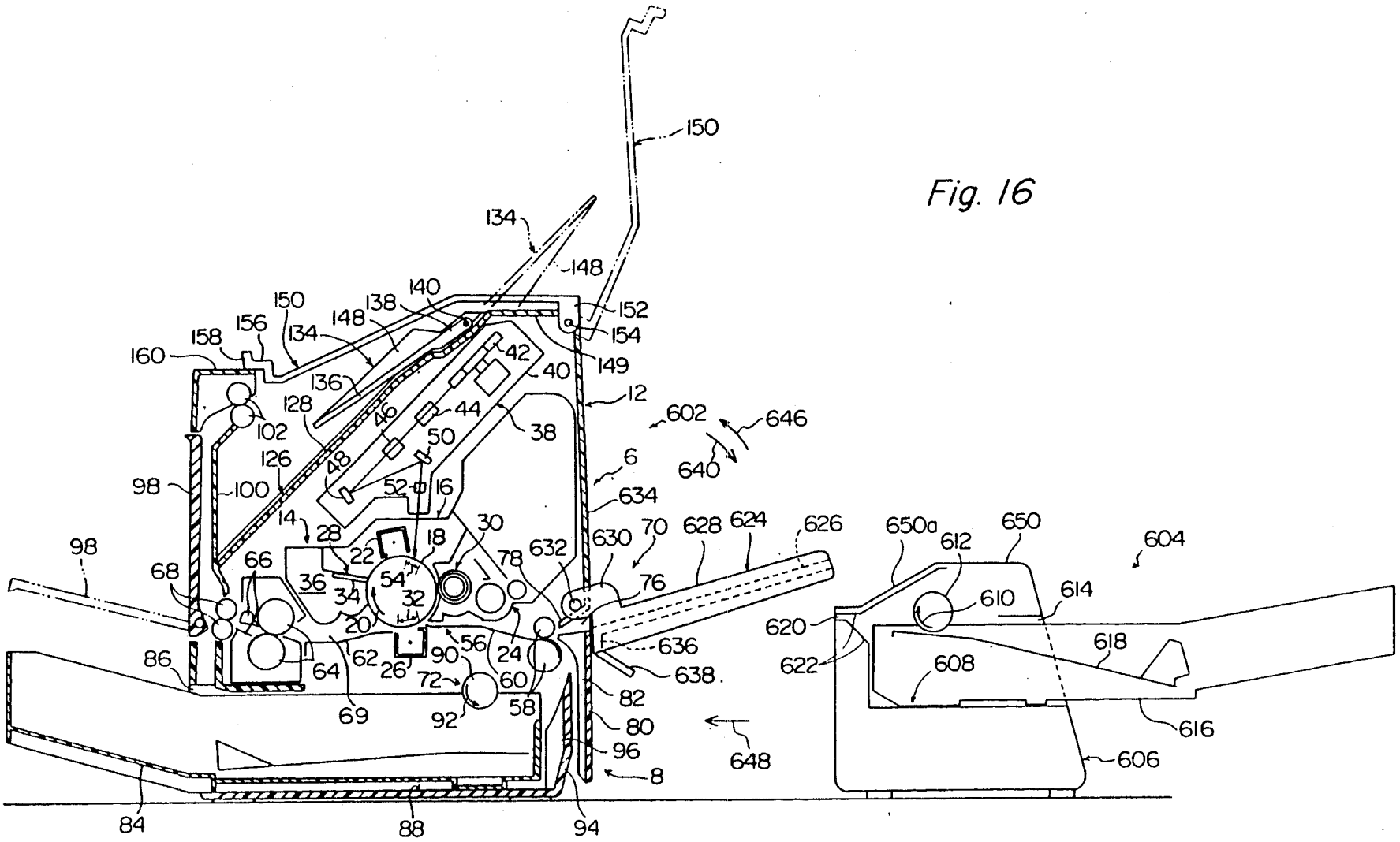
FIG. 16 is a simplified sectional view of one example of a fourth embodiment of the sheet feeding system of the invention with a feed unit spaced from the main body thereof.
Figure 17:
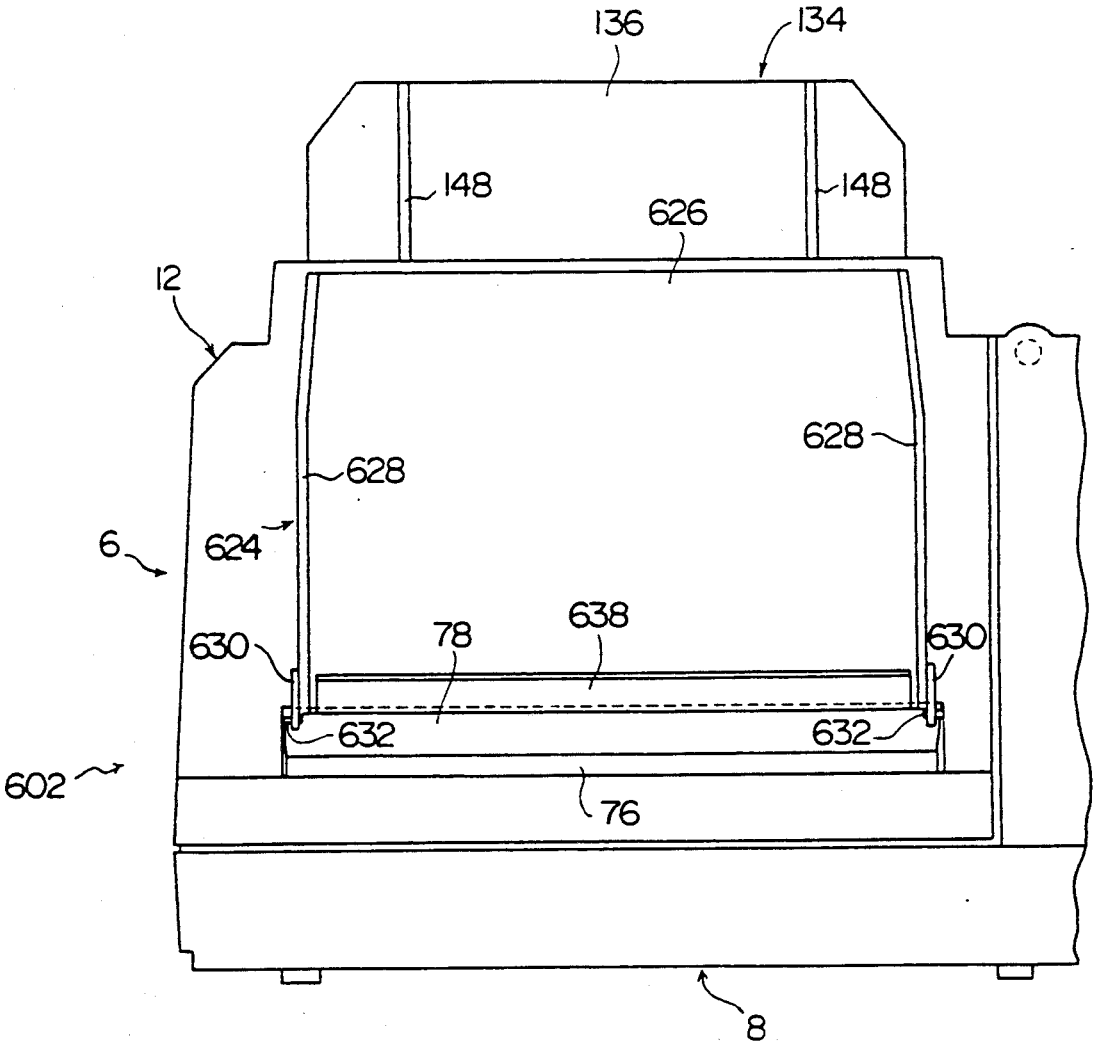
FIG. 17 is a view showing part of the main body of the sheet feeding system of FIG. 16 as viewed from the right in FIG. 16.
Figure 18:
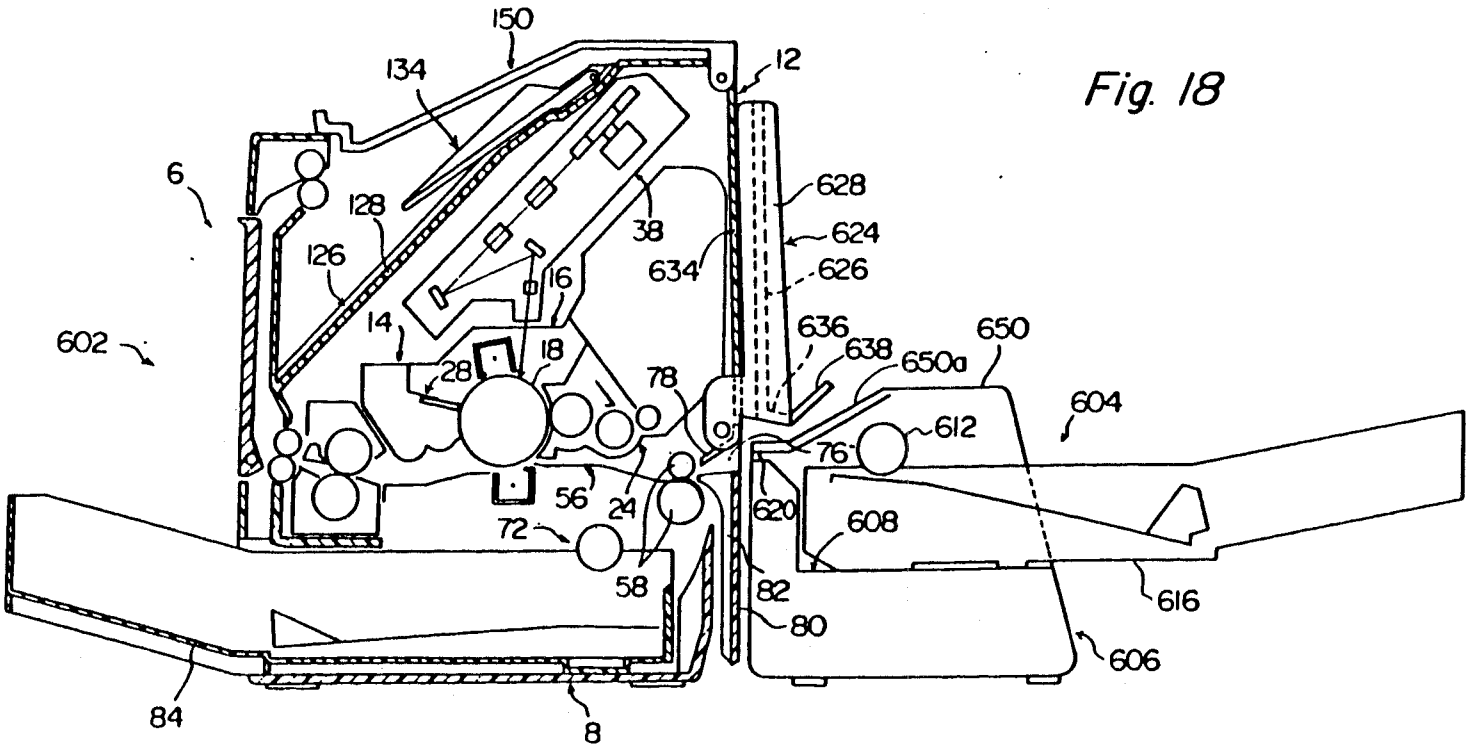
FIG. 18 is a simplified sectional view showing the sheet feeding system of FIG. 16 in which the feed unit is mounted on the main body.

FIGS. 16 to 18 show one example of a fourth embodiment of the sheet feeding system of the invention.

In FIGS. 16 and 17, the sheet feeding system is provided with a main body shown generally at 602 and a feed unit shown generally at 604. A comparison of FIG. 1 with FIG. 16 readily shows that the main body 2 of the first embodiment and the main body 602 of the fourth embodiment are basically the same in structure except that some difference exists in the structure of the table. Accordingly, parts of the fourth embodiment which are the same as parts of the first embodiment are designated by like reference numerals and will not be described a second time.

In FIG. 16, the feed unit 604 is provided with a substantially rectangular parallelpiped feed housing 606 and has a feed means mounted on it. The feed means has a cassette receiving section 608 defined within the housing 606, and a feed roller 612 which is adapted to be rotated in the direction shown by an arrow 610. The feed roller 612 is disposed above the cassette receiving section 608. A loading opening 614 is defined in the right surface in FIG. 16 of the housing 606, and a box-like cassette 616 is detachably loaded into the cassette-receiving section 608 through the opening 614. A carrying plate 618 is provided in the cassette 616 and is adapted to be biased upwardly about a fulcrum point at its rear end by the action of a biasing means (not shown). Stacked sheet materials can be filled into the carrying plate 618. A delivery opening 620 is defined in the left surface of the feed housing 516 in FIG. 16. A pair of guide plates 622 defining a delivery passage are disposed between the delivery opening 620 and the cassette-receiving section 608.

When the cassette 616 is disposed in this feed unit 604 and the feed roller 612 is rotated in the direction of arrow 610, the upper most sheet material in the cassette 616 is fed from the cassette 616 by the feed roller 612. The fed sheet material passes between the pair of guide plates 622 and is conveyed through the delivery opening 620 to the outside of the feed housing 606.

The fourth embodiment is further constructed as shown below with regard to the hand-insertion feed means 70. The hand-insertion feed means 70 includes a table 624. The table 624 is provided with a plate-like main body 626 and side walls 628 provided at both sides of the main body 626 (see FIG. 17). The inner surfaces of the side walls 628 act as a guide for guiding the sheet material in the inserting direction. A supporting protrusion 630 is integrally connected to an end portion (the downstream end portion along the sheet inserting direction, and in FIG. 16, the left end portion) of each of the side walls 628 and extends to the left in FIG. 16. The supporting projections 630 are pivotally mounted on a bracket member (not shown) secured to the inner surface of a right-hand wall 634 of the housing 12 via supporting pins 632. In the illustrated embodiment, an abutting piece 636 is connected to and extends generally perpendicularly from the base portion (the downstream end portion in the sheet inserting direction) of the main body 626 of the table 624, and a guide projecting piece 638 is provided integrally at the end of the abutting piece 636.

With the above structure, when a sheet material is to be fed via the hand-insertion feed means 70, the table 624 is held at a feed position shown in FIG. 16. When the table 624 is pivoted downwardly in the direction of an arrow 640, the abutting piece 636 abuts with the wall 80 of the lower housing 8 to hold the table 624 precisely at the feed position. When in the feed position, the upper surface of the main body 626 of the table 624 extends substantially horizontally toward the introduction opening 76 defined in the right surface of the machine housing 6. Accordingly, when a sheet material is positioned on the upper surface of the main body 626 and moved along the inner surfaces of the side walls 628, the sheet material is introduced into the machine housing 6 through the introduction opening 76. The sheet material so introduced passes between the upper edge of the guiding protrusion 82 of the wall 80 and the guide plate 78 and is fed into the conveying passage 69. On the other hand, when the table 624 is to be stored, the table 624 is positioned at a storage position shown in FIGS. 17 and 18. When the table 624 is pivoted upwardly from the feed position by about 90 degrees in the direction shown by arrow 646, the upper edges of the side walls 628 of the table 624 abut with the wall 634 of the housing 12 to hold the table 624 in the storage position. When in the storage position, the table 624 extends vertically and substantially along the wall 634 of the opening-closing housing 12, and is stored on the outside of the wall 634, as shown in FIG. 18. When the table 624 is thus held at the storage position, the introduction opening 76 is visible from the outside below the abutting piece 636 of the table 624.

In the illustrated embodiment, the feed unit 604 is adapted to be detachably secured to that part of the machine housing 6 at which the introduction opening 76 is formed.

To secure the feed unit 604 to the housing 6, the table 624 is positioned at the storage position in the manner described above. Then, the feed unit 604 is moved in the direction of arrow 648 (FIG. 16) and positioned at the position shown in FIG. 18. Thereafter, the feed unit 604 is connected to the main body 602 of the machine by a releasable lock means (not shown). The lock means (not shown) may be a known means equipped with, for example, an engaging member, which is free to pivot between a locking position in which it engages part of the main body 602 and a non-locking position in which it does not so engage the main body 602. When the feed unit 604 is thus secured, the delivery opening 620 defined in the feed housing 606 is aligned with the introduction opening 76. As a result, the sheet material delivered from the delivery opening 620 is introduced into the machine housing 6 through the introduction opening 76 and fed to the conveying passage through the space between the upper edge of the guide protrusion 82 and the guide plate 78. Furthermore, as shown in FIG. 18, a space is created between the abutting piece 636 (as well as the guide projecting piece 638) and a part 650*a* of an upper wall 650 of the housing 606, and the left end of this space in FIG. 18 is aligned with the introduction opening 76. The delivery opening 620 is aligned with lower portion of the introduction opening 76, and the above-mentioned space can be used as an insertion opening for inserting a sheet material by hand. The sheet material inserted through the insertion opening is guided through an insertion path defined between the part 650*a* of the upper wall 650 and the guide projecting piece 638 (as well as the abutting piece 636) and is fed to the conveying passage through the introduction opening 76.

The feed unit 604 may be removed by releasing the locking means (not shown) and then moving the feed unit 604 in a direction opposite to the direction of arrow 648. When the hand-insertion feed means 70 is used, the table 624 is pivoted in the direction of arrow 646 and positioned at the feed position.

We claim:

1. A sheet feeding system for an image forming machine, comprising:

a main body having a conveying passage therein for guiding sheet materials therethrough;

feed means for feeding sheet materials to said conveying passage, said feed means including a feed roller;

a sorter means, having a plurality of bin trays into which sheet materials can be sorted, for receiving sheet materials discharged from said conveying passage; and supporting means for supporting said feed means and said sorter means on one side of said main body, said supporting means being detachably mounted on said main body;

wherein said main body includes a receiving section therein for receiving sheet materials guided through said conveying passage, and means for guiding sheet materials from said conveying passage, above said receiving section, through an introduction opening defined in said supporting means and into said sorting means.

2. A sheet feeding system as recited in claim 1, wherein said sorter means is supported above said feed means by said supporting means.

3. A sheet feeding system as recited in claim 1, wherein said guiding means comprises an auxiliary receiving member pivotally mounted to said receiving section of said main body for pivotal movement between a first position downstream in a sheet feeding direction of said receiving section in which said auxiliary receiving member is adapted to receive sheet materials discharged from said conveying passage and a second position above said receiving section in which said auxiliary member is adapted to guide sheet materials from below from said conveying passage into said sorter means.

4. A sheet feeding system as recited in claim 3, further comprising an upper cover member pivotally mounted to said main body for pivotal movement between an open position which leaves said receiving section exposed and a closed position in which said upper cover member covers said receiving section and is adapted to guide sheet materials from above from said conveying passage to said sorter means.

5. A sheet feeding system for an image forming machine, comprising:

a main body having a housing, a conveying passage for conveying sheet materials therethrough, a receiving section for receiving sheet materials from said conveying passage, an introduction opening formed in said housing for introducing sheet materials into said conveying passage and a delivery opening for delivering sheet materials from said conveying passage;

reintroducing conveying means for selectively conveying sheet materials from said delivery opening and into said introduction opening;

said delivery opening being defined in an upper portion of one end of said main body;

said reintroducing conveying means comprising a reintroducing conveying passage which extends along the upper portion of said main body from said one end to the other end of said main body and extends downwardly along the outside of said housing, one side of said reintroducing conveying passage being defined by an outer wall of said housing; and said introduction opening being defined at said other end of said main body.

6. A sheet feeding system as recited in claim 5, wherein said reintroducing conveying means is operative to convey sheet materials from said delivery opening, outside said housing and into said introduction opening.

7. A sheet feeding system as recited in claim 5, further comprising a table pivotally mounted to said housing for movement between a feed position at which said table extends substantially horizontally from a location adjacent said introduction opening outwardly away from said housing and is adapted to provide for hand insertion of sheet materials into said introduction opening, and a storage position at which said table extends substantially vertically along said outer wall of said housing and defines another side of said reintroducing conveying passage.

8. A sheet feeding system as recited in claim 5, further comprising an auxiliary unit disposed outwardly of said housing and having a wall which defines another side of said reintroducing conveying passage.

9. A sheet feeding system as recited in claim 8, wherein said auxiliary unit includes a feed means for feeding sheet materials into said introduction opening and a sorter means for selectively receiving and sorting sheet materials delivered from said delivery opening.

10. A sheet feeding system as recited in claim 5, further comprising a feed roller means, mounted at an upper portion of said other end of said main body, for feeding sheet materials delivered through said delivery opening further downstream.

11. A sheet feeding system as recited in claim 5, further comprising an auxiliary roller means, mounted at a vertically intermediate portion of said other end of said main body, for feeding sheet materials delivered toward said introduction opening further downstream in a sheet feeding direction.

12. A sheet feeding system as recited in claim 5, further comprising an auxiliary receiving member pivotally mounted to said main body for movement between a first position in which said auxiliary receiving member shuts off said reintroducing conveying passage and acts as an auxiliary receiving portion for receiving sheet materials delivered from said delivery opening, and a second position in which said auxiliary receiving member defines one side of a part of said reintroducing conveying passage to guide sheet materials delivered from said delivery opening toward said introduction opening.

13. A sheet feeding system as recited in claim 12, further comprising an upper cove member pivotally mounted to said housing for pivotal movement between an open position in which an inside portion of said housing is exposed, and a closed position in which said housing is closed and said upper cover member defines the other side of said part of said reintroducing conveying passage for guiding sheet materials delivered from said delivery opening toward said introduction opening.

14. A sheet feeding system for an image forming machine, comprising:

a main body having a housing, a conveying passage for conveying sheet materials therethrough, a receiving section for receiving sheet materials from said conveying passage, an introduction opening formed in said housing for introducing sheet materials into said conveying passage and a delivery opening for delivering sheet materials from said conveying passage;

reintroducing conveying means for selectively conveying sheet materials from said delivery opening and into said introduction opening;

said delivery opening being defined in an upper portion of one end of said main body;

said reintroducing conveying means comprising a reintroducing conveying passage which extends along the upper portion of said main body from said one end to the other end of said main body and extends downwardly along the outside of said housing;

said introduction opening being defined at said other end of said main body;

a sorter; and a passage switching means, disposed in an upper portion of said other end of said main body and adapted for movement between a first position and a second position, for conducting sheet materials delivered from said delivery opening toward said introduction opening when in said first position, and for permitting sheet materials delivered from said delivery opening to be feed to said sorter when in said second position.

15. A sheet feeding system as recited in claim 14, further comprising a feed roller means, mounted at an upper portion of said other end of said main body, for feeding sheet materials delivered through said delivery opening further downstream.

16. A sheet feeding system as recited in claim 14, further comprising an auxiliary roller means, mounted at a vertically intermediate portion of said other end of said main body, for feeding sheet materials delivered toward said introduction opening further downstream in a sheet feeding direction.

17. A sheet feeding system as recited in claim 14, further comprising an auxiliary receiving member pivotally mounted to said main body for movement between a first position in which said auxiliary receiving member shuts off said reintroducing conveying passage and acts as an auxiliary receiving portion for receiving sheet materials delivered from said delivery opening, and a second position in which said auxiliary receiving member defines one side of a part of said reintroducing conveying passage to guide sheet materials delivered from said delivery opening toward said introduction opening.

18. A sheet feeding system as recited in claim 17, further comprising an upper cover member pivotally mounted to said housing for pivotal movement between an open position in which an inside portion of said housing is exposed, and a closed position in which said housing is closed and said upper cover member defines the other side of said part of said reintroducing conveying passage for guiding sheet materials delivered from said delivery opening toward said introduction opening.

19. A sheet feeding system for an image-forming machine, comprising a main body having a conveying passage for guiding a sheet material and a receiving section for receiving a sheet material having an image formed thereon during conveyance through the conveying passage, and a sorter having a plurality of bin trays for sorting sheet materials and distributing them among the bin trays, wherein an auxiliary receiving member is mounted on the receiving section so as to be free to pivot between a first position at which it is positioned downstream of the receiving section and receives the sheet material discharged from the conveying passage and a second position at which it is positioned above the receiving section and guides the upper surface of the sheet material discharged from the conveying passage and conducts it to the sorter.

* * * * *